US007516734B2

(12) United States Patent
Tominaga et al.

(10) Patent No.: US 7,516,734 B2
(45) Date of Patent: Apr. 14, 2009

(54) COMMON RAIL HAVING ORIFICE

(75) Inventors: Takashi Tominaga, Kariya (JP); Tadashi Nishiwaki, Kariya (JP)

(73) Assignee: Denso Corporation, Kariya (JP)

( * ) Notice: Subject to any disclaimer, the term of this patent is extended or adjusted under 35 U.S.C. 154(b) by 109 days.

(21) Appl. No.: 11/645,623

(22) Filed: Dec. 27, 2006

(65) Prior Publication Data

US 2007/0169751 A1 Jul. 26, 2007

(30) Foreign Application Priority Data

Jan. 20, 2006 (JP) ..... 2006-012478
Feb. 20, 2006 (JP) ..... 2006-042336
Sep. 7, 2006 (JP) ..... 2006-242946

(51) Int. Cl.
*F02M 69/46* (2006.01)
*F02M 55/02* (2006.01)

(52) U.S. Cl. ..... 123/456; 123/467; 123/468

(58) Field of Classification Search ..... 123/456, 123/468, 469, 467
See application file for complete search history.

(56) References Cited

U.S. PATENT DOCUMENTS 6,415,768 B1 * 7/2002 Usui ..... 123/468
6,463,909 B2 * 10/2002 Asada et al. ..... 123/456
6,848,424 B2 2/2005 Watanabe
6,871,638 B2 3/2005 Kondo
6,929,288 B2 8/2005 Usui
6,981,722 B2 1/2006 Watanabe
7,216,631 B2 5/2007 Nishiwaki et al.
2004/0139945 A1 * 7/2004 Kondo ..... 123/456
2005/0098159 A1 * 5/2005 Nishiwaki ..... 123/468
2005/0146134 A1 7/2005 Usui
2005/0200120 A1 9/2005 Usui
2007/0006848 A1 * 1/2007 Ricco et al. ..... 123/456

FOREIGN PATENT DOCUMENTS

DE 10 2005 002 958 A1 10/2005
EP 1 426 608 A2 6/2004
EP 1 491 759 A1 12/2004

(Continued)

OTHER PUBLICATIONS

EPO Search Report dated Apr. 27, 2007.

(Continued)

*Primary Examiner*—Thomas N Moulis
(74) *Attorney, Agent, or Firm*—Nixon & Vanderhye PC

(57) ABSTRACT

A bush incorporated in a common rail is formed with a smallest diameter orifice having a small inner diameter and an adjacent orifice having an inner diameter larger than that of the smallest diameter orifice on an inner peripheral face of the bush. A press-fitted portion, which is press-fitted into an inside-outside communication hole, and a non-press-fitted portion, which has a smaller outer diameter than the press-fitted portion, are formed on an outer peripheral face of the bush. The smallest diameter orifice and the press-fitted portion are deviated from each other in an axial direction of the bush to prevent an overlap in a radial direction of the bush. Thus, even if the bush is tightly press-fitted into the inside-outside communication hole, decrease of the inner diameter of the smallest diameter orifice can be averted.

15 Claims, 15 Drawing Sheets

FOREIGN PATENT DOCUMENTS

| | | |
|---|---|---|
| EP | 1 653 076 A1 | 5/2006 |
| FR | 2845129 | 4/2004 |
| JP | 9-112380 | 4/1997 |
| JP | 9-303232 | 11/1997 |
| JP | 2000-27731 | 1/2000 |
| JP | 2001-82663 | 3/2001 |
| JP | 2001-82664 | 3/2001 |
| JP | 2001-207930 | 8/2001 |

OTHER PUBLICATIONS

European Search Report dated Jul. 24, 2007 in Application No. 07100052.5.

Chinese Office Action dated Apr. 18, 2008, issued in the corresponding Chinese Patent Application No. 200710002089.5, with English translation.

European Examination Report dated Sep. 4, 2008, issued in the corresponding European Patent Application No. 07 100 052.5-2311.

* cited by examiner

COMMON RAIL HAVING ORIFICE

CROSS REFERENCE TO RELATED APPLICATION

This application is based on and incorporates herein by reference Japanese Patent Applications No. 2006-12478 filed on Jan. 20, 2006, No. 2006-42336 filed on Feb. 20, 2006 and No. 2006-242946 filed on Sep. 7, 2006.

BACKGROUND OF THE INVENTION

1. Field of the Invention

The present invention relates to a common rail mounted in a pressure accumulation fuel injection device for accumulating high-pressure fuel.

2. Description of Related Art

A pressure accumulation fuel injection device is known as a fuel supply device of an internal combustion engine such as a diesel engine for pressurizing fuel suctioned from a fuel tank with a pump and for supplying the fuel into combustion chambers of respective cylinders of the engine from injectors through injection. The pressure accumulation fuel injection device has a common rail for accumulating high-pressure fuel discharged by a fuel supply pump. The pressure accumulation fuel injection device distributes the high-pressure fuel accumulated in a pressure accumulation chamber of the common rail to multiple injectors mounted in the respective cylinders of the engine and injects the fuel into the combustion chambers of the respective cylinders of the engine from injection holes formed in axial tip ends of the injectors.

An example of conventional common rail is shown in FIG. 20. The common rail 201 is a pressure accumulation vessel for accumulating high-pressure fuel pressure-fed from a high-pressure fuel pump such as a supply pump. The common rail 201 is formed with a pressure accumulation chamber (center hole) 223 for accumulating the high-pressure fuel inside. The common rail 201 has a pipe joint 221 formed with an external screw 225 on an outer peripheral face thereof. An external pipe such as a high-pressure pump pipe or an injector pipe is connected to the external screw 225. A central portion of the outer end of the pipe joint 221 communicates with the pressure accumulation chamber 223 through an inside-outside communication hole 224.

The inside-outside communication hole 224 is formed with an orifice α for reducing pressure pulsation accompanying an injection operation of an injector or pressure pulsation accompanying a pressure-feeding operation of the high-pressure fuel pump. The conventional orifice α is provided by forming a hole directly in a main body 220 (rail main body) of the common rail 201. Because of restrictions related to hole making process, the orifice α is formed at the bottom of the inside-outside communication hole 224. As shown in FIG. 20, the orifice α opens into the pressure accumulation chamber 223.

Since the high-pressure fuel is accumulated in the pressure accumulation chamber 223, the high pressure acts on an inner peripheral face of the pressure accumulation chamber 223. The orifice α having a small diameter opens in the inner peripheral face of the pressure accumulation chamber 223 while the orifice α crosses with the inner peripheral face. Hereinafter, the opening of the orifice α, at which the orifice α crosses with the inner peripheral face, is referred to as a crossing hole. As the crossing hole decreases, greater stress is concentrated in an opening edge of the crossing hole. Therefore, the common rail 201 with the orifice α formed integrally in the rail may body 220 by the hole making process is used in a pressure accumulation fuel injection device using relatively low-pressure accumulation value of the pressure accumulation chamber 223 (180 MPa or lower, for example).

In recent years, aiming to improve exhaust characteristics and the like, increase of the common rail pressure over 180 MPa has been required. However, since the crossing hole of the orifice α is small in the common rail 201 with the orifice α formed integrally in the rail main body 220 by the hole making process, it is difficult to ensure a safety margin related to fatigue strength.

Aiming to ensure the safety margin related to the fatigue strength, a proposed common rail 201 has a separate bush that is separate from the rail main body 220 and that is formed with an orifice α instead of forming the orifice α directly in the rail main body 220. The bush is press-fitted to an inside of the inside-outside communication hole 224. Thus, the crossing hole is enlarged (for example, as described in JP-A-2001-82663 or JP-A-2001-280217.

The conventional technology of press-fitting the bush formed with the orifice α to the inside of the inside-outside communication hole 224 press-fits the outer peripheral face of the orifice α into the inside-outside communication hole 224. There is a possibility that the bush receives a differential pressure between the pressure in the pressure accumulation chamber 223 and the exterior pressure. Therefore, in order to prevent the bush from coming off of the inside-outside communication hole 224, the bush is tightly press-fitted to the inside of the inside-outside communication hole 224.

Therefore, there is a possibility that an inner diameter of the orifice α is changed by distortion caused by the press-fitting. If the inner diameter of the orifice α changes, designed passing of the fuel is disturbed. As a result, there is a possibility that injection characteristics of the injector change and designed injection cannot be performed.

The bush formed with the orifice α is press-fitted into the inner periphery of the external screw 225 of the pipe joint 221. Since the bush is tightly press-fitted to the inside of the inside-outside communication hole 224, there is a possibility that the external screw 225 formed on the pipe joint 221 is deformed by the distortion caused by the press-fitting. IF the external screw 225 is deformed, there is a possibility that a trouble is caused in screwing of a pipe nut for fixing the external pipe to the joint 221.

Another example of common rail mounted in the pressure accumulation fuel injection device has a substantially cylindrical rail main body, in which a pressure accumulation chamber for accumulating the high-pressure fuel inside is formed in a longitudinal direction (axial direction). The rail main body is formed with multiple inside-outside communication holes for connecting the pressure accumulation chamber with the outside. Out of the multiple inside-outside communication holes, the inside-outside communication hole provided upstream of the pressure accumulation chamber with respect to a flow direction of the fuel communicates with the discharge hole of the fuel supply pump through a high-pressure pump pipe. The other multiple inside-outside communication holes provided downstream of the pressure accumulation chamber with respect to the flow direction of the fuel communicate with the insides of the injectors through multiple injector pipes.

The fuel supply pump incorporates a plunger driven by a cam to linearly reciprocate inside the fuel supply pump. Thus, the high-pressure fuel is intermittently discharged from the discharge hole of the fuel supply pump into the pressure accumulation chamber through the high-pressure pump pipe in a predetermined cycle. Accordingly, the high pressure is generated in the high-pressure pump pipe in a pulsating manner in accordance with the shape of the cam. The pressure pulsation (discharge pulsation of the fuel supply pump) is propagated to the inside of the pressure accumulation chamber as a pressure wave.

The multiple injectors connected with the common rail open intermittently at different injection timings to perform the fuel injections. The pressure in the injector pipe temporarily decreases when the injector opens. Therefore, pressure pulsation of the high pressure and the low pressure is generated in the injector pipe. The pressure pulsation is propagated to the inside of the pressure accumulation chamber as a pressure wave (reflection wave generated in accordance with opening and closing of the injector).

In the pressure accumulation chamber of the common rail, the pressure wave from the fuel supply pump merges with the reflection waves from the injectors. Therefore, even during a constant operation, the fuel pressure in the pressure accumulation chamber of the common rail is not constant pressure but fluctuates. The pressure pulsation affects valve opening timing, valve closing timing and fuel injection pressure of the injector of the same cylinder or the other cylinder. As a result, the injection timing and the fuel injection amount vary and a difference is caused in the injection amount among the cylinders.

Therefore, conventionally, orifices (fixed restrictors) are provided in the inside-outside communication holes of the rail main body of the common rail or fuel passages of pipe connectors fluid-tightly connecting the injector pipes with the rail main body of the common rail. Thus, propagation of the reflection wave, which is generated by opening and closing of the injector in a certain cylinder, to the inside of the pressure accumulation chamber of the common rail is inhibited to reduce the influence on the fuel injections in the other cylinders. In addition, the reflection wave generated by the opening and closing of the injector of the certain cylinder is damped to reduce the influence on the next injection in the same cylinder.

However, in the conventional common rail, there is a manufacture variation in an orifice diameter of the orifice, which is provided in the inside-outside communication hole communicating with the inside of the injector of each cylinder of the engine or in the fuel passage of the pipe connector. The propagation of the reflection wave, which is caused by the opening and closing of the injector, to the inside of the pressure accumulation chamber of the common rail cannot be prevented sufficiently by only providing the orifice in the inside-outside communication hole or the fuel passage.

A common rail aiming to damp a reflection wave from an injector of a certain cylinder and to eliminate an influence on next injection in the same cylinder and fuel injection in another cylinder is described in JP-A-2001-207930. In this common rail, an orifice is formed in a piston capable of sliding in the inside-outside communication hole of the rail main body of the common rail or the fuel passage of the pipe joint. The piston follows the pressure pulsation in the rail main body and the reflection waves from the injectors to damp the pressure pulsation in the rail main body and the reflection waves from the injectors. A first spring is provided upstream of the piston with respect to the fuel flow direction and a second spring is provided downstream of the piston. An end of the piston provides a first spring seat portion for receiving a spring load of the first spring and the other end of the piston provides a second spring seat portion for receiving a spring load of the second spring.

In this common rail, the orifice is formed to penetrate through the entity of the piston in the axial direction. Therefore, a process length of the orifice is long. A process time of orifice forming process requiring highly accurate processing technology is lengthened. As a result, a cost is increased. This common rail requires two springs (first and second springs). Therefore, the number of the parts is increased, increasing a cost. In this common rail, selection of spring constants of the first and second springs for damping the pressure pulsation and the reflection waves is difficult. For example, it is difficult to decide which spring constant should be increased out of the spring constants of the first and second springs. Therefore, the pressure waves (discharge pulsation of fuel supply pump and reflection waves from injectors) significantly affecting the injection amount characteristics (injection timing, injection amount, injection ratio and the like) of each cylinder of the engine cannot be sufficiently restricted to be small.

The influence of the pressure pulsation inside the pressure accumulation chamber of the common rail on the valve opening timing, the valve closing timing and the fuel injection pressure of the same cylinder or the other cylinder cannot be eliminated. As a result, the difference in the injection pressure or the injection amount among the cylinders cannot be sufficiently restricted to be small.

SUMMARY OF THE INVENTION

It is an object of the present invention to provide a common rail capable of inhibiting a change of an inner diameter of a smallest diameter orifice formed in a bush even if the bush formed with the orifice is inserted into an inside-outside communication hole. It is another object of the present invention to provide a common rail capable of inhibiting deformation of an external screw formed on a pipe joint even if the bush formed with the orifice is press-fitted into the inside-outside communication hole. It is yet another object of the present invention to provide a common rail capable of restricting an injection pressure difference and injection amount difference among cylinders by restricting a pressure wave, which significantly affects injection amount characteristics of each cylinder of an internal combustion engine, while restricting an increase of a cost by shortening a process length of an orifice in an orifice forming member.

According to an aspect of the present invention, a common rail has a bush formed with multiple stages of orifices on an inner peripheral face thereof and with a press-fitted portion, which is press-fitted into an inside-outside communication hole, on an outer peripheral face thereof. The orifice having the smallest inner diameter is deviated from the press-fitted portion in an axial direction of the bush to prevent an overlap therebetween in a radial direction of the bush.

Even if the bush is press-fitted into the inside-outside communication hole and the inner diameter of the inner periphery of the press-fitted portions is changed, the inner diameter of the smallest diameter orifice is not changed by the press-fitting because the smallest diameter orifice is provided at a position axially deviated from the portion deformed by the press-fitting. Thus, the diameter of the smallest diameter orifice provided in the common rail is unchanged, so the problems such as change of injection characteristics of the injector can be inhibited.

According to another aspect of the present invention, the press-fitted portion of the bush is press-fitted into the inside-outside communication hole at a position that does not overlap with an external screw in a radial direction of the inside-outside communication hole. Thus, even if the bush is press-fitted into the inside-outside communication hole, deformation of the external screw due to distortion caused by the press-fitting can be averted. Accordingly, troubles in screwing of an external pipe such as a high-pressure pump pipe or an injector pipe can be averted.

According to yet another aspect of the present invention, a common rail has an orifice forming member slidably provided in a cylinder. If pressure pulsation is caused upstream or downstream of the orifice forming member with respect to a fuel flow direction and the pressure pulsation reaches the orifice forming member in the form of a pressure wave, the orifice forming member moves toward a low-pressure side because of an influence of the pressure wave. Thus, the pressure pulsation is attenuated. Since an orifice is formed in the orifice forming member, the pressure pulsation is further attenuated by an orifice effect. Accordingly, the pressure pulsation (pressure wave) propagated from the outside to the inside of a pressure accumulation chamber of the cylindrical section or the pressure pulsation (pressure wave) propagated from the inside to the outside of the pressure accumulation chamber of the cylindrical section can be sufficiently reduced. Thus, the pressure inside the pressure accumulation chamber of the cylindrical section is stabilized and an influence on the injection characteristics of each cylinder of the engine can be inhibited. As a result, injection pressure difference and injection amount difference among the cylinders can be sufficiently reduced.

A large diameter hole connecting the orifice with the inside-outside communication hole upstream or downstream of the orifice forming member with respect to the fuel flow direction is formed in the orifice forming member upstream or downstream of the orifice with respect to the fuel flow direction. The inner diameter of the large diameter hole is set larger than a restriction diameter of the orifice. Thus, process length of the orifice can be shortened with respect to total length of the orifice forming member in the axial direction. Accordingly, orifice processing time necessary for the processing of the orifice, which requires highly accurate processing technology, is shortened. Moreover, two springs of the first and second springs are not required by this structure, so the number of parts is reduced. As a result, increase of a cost can be inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 9AA is a side view showing the prevention member of FIG. 9A;

FIG. 9BB is a side view showing the prevention member of FIG. 9B;

DETAILED DESCRIPTION OF EXAMPLE EMBODIMENTS

Figure 1:
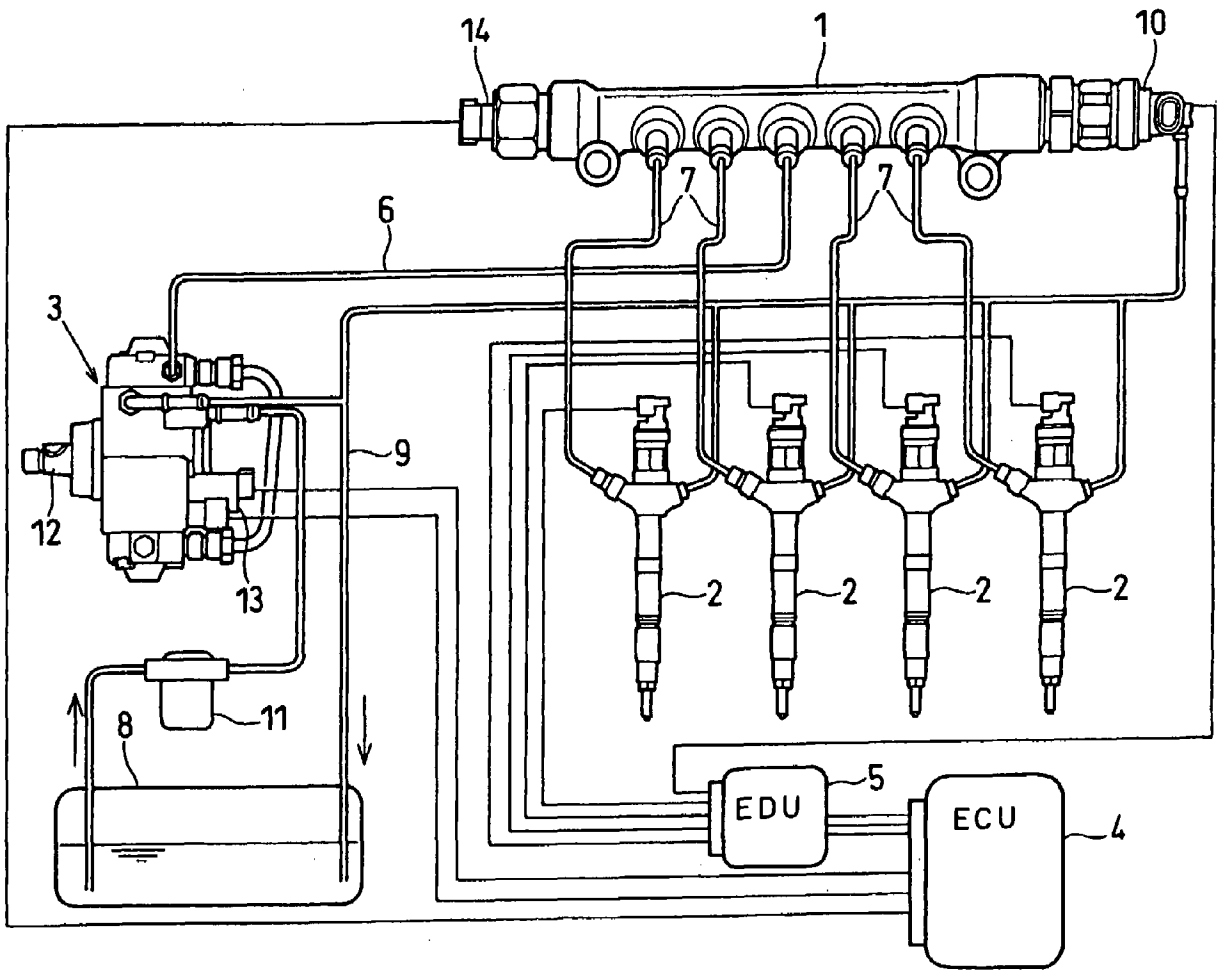
FIG. 1 is a schematic diagram showing a pressure accumulation fuel injection device according to an example embodiment of the present invention.

Referring to FIG. 1, a pressure accumulation fuel injection device according to a first example embodiment of the present invention is illustrated. The fuel injection device shown in FIG. 1 is a system for performing fuel injection into respective cylinders of an engine (for example, a diesel engine, not shown). The fuel injection device has a common rail 1, injectors 2, a supply pump 3, an engine control unit (ECU) 4, a drive unit (EDU) 5 and the like. The EDU 5 may be incorporated in a casing of the ECU 4.

The common rail 1 is a pressure accumulation vessel for accumulating high-pressure fuel to be supplied to the injectors 2. In order to accumulate common rail pressure corresponding to fuel injection pressure, the common rail 1 is connected with a discharge hole of the supply pump 3, which pressure-feeds the high-pressure fuel, through a high-pressure pump pipe 6. The common rail 1 is also connected with multiple injector pipes 7 for supplying the high-pressure fuel to the respective injectors 2.

A pressure reduction valve 10 functioning also as a pressure limiter is attached to a relief pipe 9 for returning the fuel from the common rail 1 to a fuel tank 8. The pressure reduction valve 10 as the pressure limiter functions as a pressure safety valve. If the common rail pressure exceeds limit set pressure, the pressure reduction valve 10 as the pressure limiter opens to limit the common rail pressure to or under the limit set pressure. The pressure reduction valve 10 opens in response to commands of the ECU 4 and the EDU 5 to quickly reduce the common rail pressure. Alternatively, a separate pressure limiter may be provided independently from the pressure reduction valve 10.

The injectors 2 are mounted in respective cylinders of the engine for injecting and supplying the fuel into the cylinders respectively. Each injector 2 has a fuel injection nozzle, an electromagnetic valve and the like. The fuel injection nozzle is connected to a downstream end of one the injector pipes 7 branching from the common rail 1 and supplies the high-pressure fuel accumulated in the common rail 1 into each cylinder through the injection. The electromagnetic valve performs lifting control of a needle accommodated in the fuel injection nozzle. Leak fuel from the injectors 2 is also returned to the fuel tank 8 through the relief pipe 9.

The supply pump 3 is a high-pressure fuel pump for pressure-feeding the high-pressure fuel to the common rail 1. The supply pump 3 has a feed pump for suctioning the fuel in the fuel tank 8 into the supply pump 3 through a filter 11 and a high-pressure pump for pressurizing the suctioned fuel to high pressure and for pressure-feeding the pressurized fuel to the common rail 1. The feed pump and the high-pressure pump are driven by a common camshaft 12. The camshaft 12 is rotated and driven by the engine.

In the supply pump 3, a suction control valve (SCV) 13 is mounted in a fuel flow passage, which introduces the fuel into a pressurization chamber pressurizing the fuel to the high pressure. The SCV 13 regulates an opening degree of the fuel flow passage. The SCV 13 is a valve controlled by a pump drive signal from the ECU 4 for regulating a suction amount of the fuel suctioned into the pressurization chamber and for changing a discharge amount of the fuel pressure-fed to the common rail 1. By regulating the discharge amount of the fuel pressure-fed to the common rail 1, the common rail pressure is regulated. The ECU 4 controls the SCV 13 to control the common rail pressure to pressure commensurate with a running state of a vehicle.

The ECU 4 has a CPU and a storage device (memory such as ROM, RAM, SRAM or EEPROM). The ECU 4 performs various types of calculation processing based on programs stored in the ROM and signals of sensors (operation states of the vehicle) inputted into the RAM and the like. For example, the ECU 4 decides a target injection amount, an injection mode, valve opening/closing timing of the injector 2, and an opening degree (energization current value) of the SCV 13 for each cylinder and for each fuel injection based on the programs stored in the ROM and the signals of the sensors (operation states of the vehicle) inputted to the RAM.

The EDU 5 has an injector drive circuit. The injector drive circuit is a drive circuit for applying valve opening drive current to the electromagnetic valve or the like of the injector 2 based on an injector valve opening signal provided by the ECU 4. By applying the valve opening drive current to the electromagnetic valve, the high-pressure fuel is injected and supplied into the cylinder. By stopping the valve opening drive current, the fuel injection is stopped. In FIG. 1, a SCV drive circuit for applying drive current to the electromagnetic valve of the SCV 13 is provided in the casing of the ECU 4. Alternatively, the SCV drive circuit may be provided in the casing of the EDU 5.

The ECU 4 is connected with sensors for sensing the operation states of the vehicle and the like such as an accelerator sensor for sensing an accelerator position, a rotation speed sensor for sensing engine rotation speed, and a coolant temperature sensor for sensing temperature of a coolant of the engine in addition to a pressure sensor 14 for sensing the common rail pressure.

Figure 2:
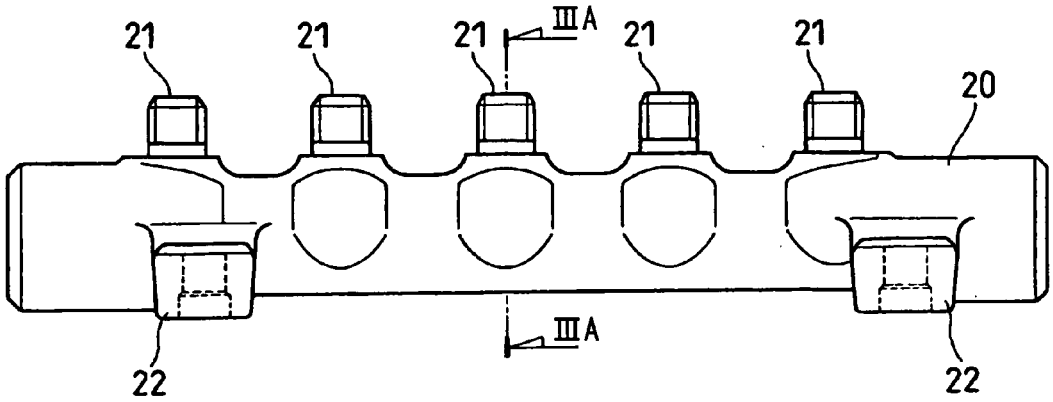
FIG. 2 is a side view showing a common rail according to the FIG. 1 embodiment.

As shown in FIG. 2, the common rail 1 has pipe joints 21 and stays 22 provided on a rail main body 20 substantially in the shape of a cylinder. The rail main body 20 accumulates the super-high-pressure fuel inside. The high-pressure pump pipe 6 and the injector pipes 7 (examples of external pipes) are connected to the pipe joints 21. The stays 22 are used to mount the rail main body 20 to a fixed member such as the engine.

Figure 3A:
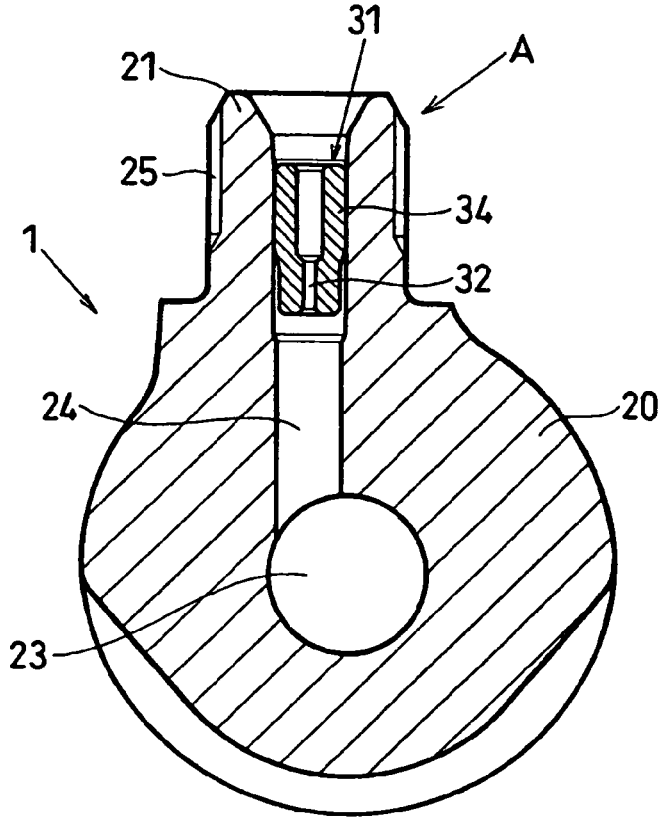
FIG. 3A is a cross-sectional view showing the common rail of FIG. 2 taken along the line IIIA-IIIA.

The rail main body 20 is a substantially bar-shaped metal product of the iron family, for example. As shown in FIG. 3A, a pressure accumulation chamber 23 for accumulating the high-pressure fuel is formed substantially in the center of the rail main body 20 such that the pressure accumulation chamber 23 axially penetrates through the rail main body 20. The axial center of the pressure accumulation chamber 23 may coincide with the center of the external diameter of the rail main body 20 or may be offset toward a side different from the pipe joints 21 by a predetermined amount.

The rail main body 20 is formed with multiple inside-outside communication holes 24 in a radial direction of the rail main body 20. The inside-outside communication holes 24 are formed in the centers of the pipe joints 24, which are located at suitable intervals along the axial direction of the rail main body 20, through hole making process. The deep end (inner end) of each inside-outside communication hole 24 opens in an inner peripheral face of the pressure accumulation chamber 23. The outer end of each inside-outside communication hole 24 opens in the center of the tip end of the pipe joint 21. A pressure receiving seat face substantially in a tapered conical shape is formed on the tip end face of the pipe joint 21. A tapered (pointed) face formed on a tip end of each of the pipes 6, 7 is inserted into the pressure receiving seat face. The outer end of the inside-outside communication hole 24 opens at the bottom of the pressure receiving seat face.

An external screw 25 is formed on an outer peripheral face of the pipe joint 21. A pipe nut provided at a connection end of each of the pipes 6, 7 is screwed to the external screw 25.

Figure 20:
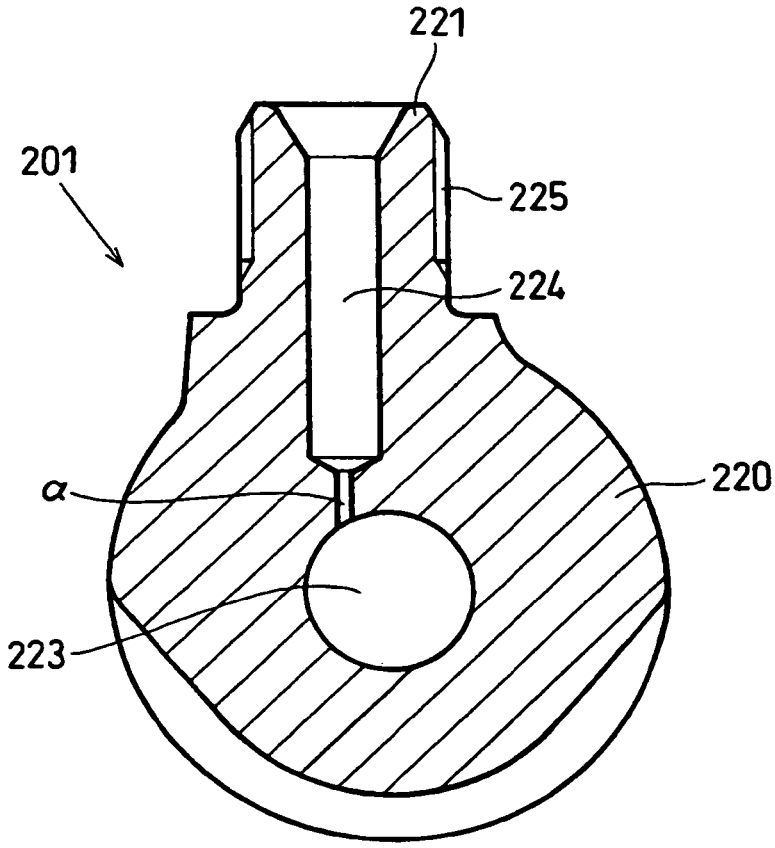
FIG. 20 PRIOR ART
FIG. 20 is a cross-sectional view showing a common rail of a prior art.

Since the high-pressure fuel is accumulated in the pressure accumulation chamber 23, the high pressure acts on an inner peripheral face of the pressure accumulation chamber 23. Stress is concentrated in a crossing hole opening in the inner peripheral face of the pressure accumulation chamber 23. The stress acting on the crossing hole increases as a diameter of the crossing hole decreases. In the example of the common rail 201 shown in FIG. 20, in which the orifice $\alpha$ for damping the pressure pulsation propagated to the common rail 201 is formed integrally in the rail main body 220 through the hole making process, the diameter of the crossing hole is small. Therefore, such a common rail 201 is used in the case where the pressure accumulation value of the pressure accumulation chamber 223 is relatively low (for example, 180 MPa or under) in order to ensure the safety margin related to the fatigue strength.

However, in recent years, increase of the accumulation pressure of the pressure accumulation chamber 223 to super high pressure (for example, 180 MPa or over) has been required to improve the exhaust characteristics and the like.

The common rail 1 according to the present embodiment has following characteristics in order to increase the accumulation pressure of the pressure accumulation chamber 23 to the super high pressure (for example, 180 MPa or over).

Figure 3B:
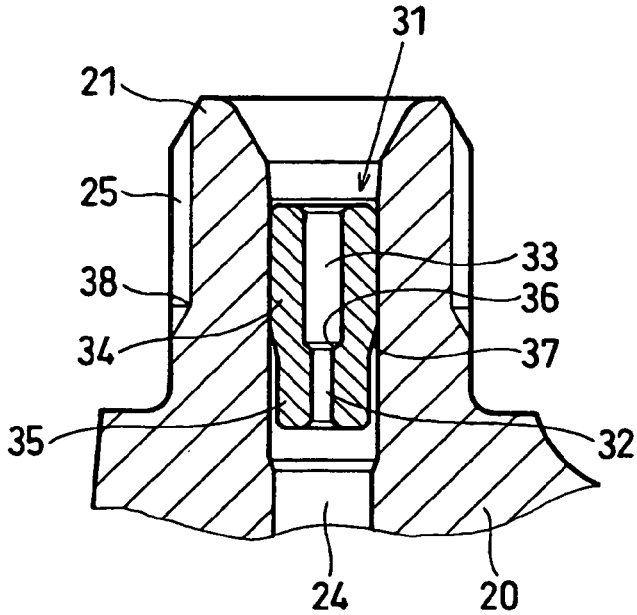
FIG. 3B is an enlarged cross-sectional view showing a portion A of the common rail of FIG. 3A.

(1) The inside-outside communication hole 24 formed in the rail main body 20 has a constant hole diameter between the outer end and the inner end or is formed such that the diameter slightly enlarges on the pipe joint 21 side as shown in FIG. 3A or 3B. The diameter of the crossing hole is set larger than the orifice diameter.

(2) A bush 31 (shown in FIG. 4) formed with an orifice for narrowing a fuel flow passage of the inside-outside communication hole 24 is press-fitted to the inside of each inside-outside communication hole 24 formed in the rail main body 20 as shown in FIGS. 3A and 3B. The material of the bush 31 is not limited as long as the material has hardness enabling the bush 31 to be press-fitted and held in the inside-outside communication hole 24. The bush 31 may be made of a metal such as the iron family metal, copper, brass or aluminum.

(3) Two-step orifices (example of multi-step orifices) for narrowing the fuel flow passage of the inside-outside communication hole 24 are formed on the inner peripheral face of the bush 31. For example, the bush 31 is formed with a smallest diameter orifice 32 having a small inner diameter (orifice size) and an adjacent orifice 33 having an inner diameter (orifice size) larger than the smallest diameter orifice 32 as shown in FIGS. 3A, 3B and 4.

Figure 4:
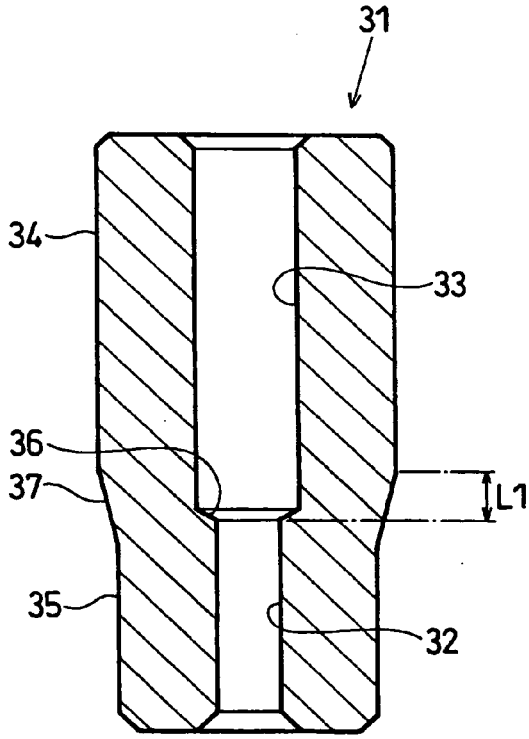
FIG. 4 is a longitudinal cross-sectional view showing a bush according to the FIG. 1 embodiment.

(4) The outer periphery of the bush 31 is formed in two steps of a press-fitted portion (large diameter portion) 34 press-fitted into the inside-outside communication hole 24 and a non-press-fitted portion (small diameter portion) 35 having a smaller diameter than the inside-outside communication hole 24 as shown in FIGS. 3A, 3B and 4.

(5) The smallest diameter orifice 32 formed in the bush 31 and the press-fitted portion 34 are provided such that the smallest orifice 32 is deviated from the press-fitted portion 34 in an axial direction of the inside-outside communication hole 24 (press-fitting direction) as shown in FIG. 4 to prevent an overlap between the smallest diameter orifice 32 and the press-fitted portion 34 in a radial direction of the inside-outside communication hole 24. The smallest diameter orifice 32 is not provided on an inner periphery of the press-fitted portion 34 but is provided on an inner periphery of the non-press-fitted portion 35.

The diameter of the crossing hole coincides with the diameter of the inside-outside communication hole 24, which is larger than the orifice diameter. Thus, the inner diameter of the crossing hole can be set larger than the orifice diameter. Accordingly, the stress concentration applied to the crossing hole can be alleviated. Thus, even if the accumulation pressure of the pressure accumulation chamber 23 is the super-high pressure (for example, 180 MPa or over), the safety margin related to the fatigue strength can be ensured.

The bush 31 is tightly press-fitted into the inside-outside communication hole 24 such that the bush 31 does not come off of the inside-outside communication hole 24 even if the bush 31 receives the differential pressure between the pressure in the pressure accumulation chamber 23 and the external pressure. Accordingly, there is a possibility that the inner diameter of the adjacent orifice 33 on the inner periphery of the press-fitted portion 34 is reduced due to distortion caused by the press-fitting.

In the present embodiment, the smallest diameter orifice 32 is deviated from the press-fitted portion 34 such that the smallest diameter orifice 32 does not overlap with the press-fitted portion 34 in the radial direction of the inside-outside communication hole 24. Therefore, even if the bush 31 is tightly press-fitted to the inside of the inside-outside communication hole 24, the problem of reduction of the inner diameter of the smallest diameter orifice 32 due to the distortion caused by the pressure-fitting can be averted.

In the present embodiment, the inner diameter of the smallest diameter orifice 32, which significantly affects the injection characteristics of the injector 2, is unchanged. Accordingly, troubles such as a change of the injection characteristics of the injector 2 due to reduction of the diameter of the smallest diameter orifice 32 can be averted.

The common rail 1 according to the present embodiment is structured such that the smallest diameter orifice 32 of the bush 31 is provided on the accumulation chamber 23 side of the press-fitted portion 34. Thus, the pressure pulsation propagated through the pipes 6, 7 is attenuated in two steps of the adjacent orifice 33 having the larger diameter than the smallest diameter orifice 32 and the smallest diameter orifice 32. As a result, an effect of attenuating the pressure pulsation can be improved.

The bush 31 according to the present embodiment is structured such that an outer peripheral face 37 of a transitional portion 36 between the smallest diameter orifice 32 and the adjacent orifice 33 is a tapered face, a diameter of which reduces toward the pressure accumulation chamber 23 as shown in FIG. 4. The transitional portion 36 between the smallest diameter orifice 32 and the adjacent orifice 33 is provided at the inner periphery of the tapered face. Thus, the minimum thickness of the inner periphery of the press-fitted portion 34 can be ensured. A deviation amount L1 is provided between the press-fitted portion 34 and the smallest diameter orifice 32 in the axial direction. Accordingly, propagation of the distortion caused in the press-fitted portion 34 to the smallest diameter orifice 32 can be inhibited and deformation of the smallest diameter orifice 32 can be inhibited.

The common rail 1 according to the present embodiment is structured such that a press-fitting position between the press-fitted portion 34 and the inside-outside communication hole 24 radially overlaps with a screw end (bottom end) 38 of the external screw 25 on the pressure chamber 23 side. The press-fitted portion 34 is press-fitted and located inside the inner periphery of the bottom end 38. Thus, thickness of the press-fitted portion 34 of the bush 31 is added to the inner periphery of the bottom end 38 to increase the thickness on the radially inner side of the bottom end 38. The bottom end 38 of the external screw 25 is a minimum screw strength portion having the smallest screw strength in the pipe joint 21. The thickness of the press-fitted portion 34 of the bush 31 is added to the inner periphery of the smallest screw strength portion, so the stiffness of the smallest screw strength portion is increased. As a result, reliability of the pipe joint 21 can be improved.

Next, a common rail according to another example embodiment of the present invention will be explained in reference to FIG. 5.

When the bush 31 is press-fitted into the inner periphery of the external screw 25 of the pipe joint 21, there is a possibility that the external screw 25 is deformed by distortion caused by the press-fitting if the inner periphery of the external screw 25 is thin. If the external screw 25 is deformed, there is a possibility that a trouble is caused when the pipe nut for fixing each of the pipes 6, 7 to the pipe joint 21 is screwed.

Therefore, the bush 31 of the common rail 1 according to the present embodiment is press-fitted at a position deviated from the external screw 25 in the axial direction such that the bush 31 does not overlap with the external screw 25 in the radial direction. The inside-outside communication hole 24 is formed with a pressure release periphery 39 having an inner diameter larger than the outer diameter of the press-fitted portion 34 on the pipe joint 21 side. A press-fitting periphery 40 having a diameter smaller than the outer diameter of the press-fitted portion 34 by a press-fitting margin is provided on the inner periphery of the inside-outside communication hole 24 only on the bottom side (pressure accumulation chamber 23 side) deeper than the pipe joint 21. As a result, the press-fitted portion 34 of the bush 31 is press-fitted only to the press-fitting periphery 40 deeper than the external screw 25. In a state in which the bush 31 is press-fitted to the inside of the inside-outside communication hole 24, the lower end of the external screw 25 and the outer end (upper end) of the press-fitted portion 34 in FIG. 5 are deviated from each other in the axial direction by a deviation amount L2.

Thus, even if the bush 31 is tightly press-fitted to the inside of the inside-outside communication hole 24, deformation of the external screw 25 due to the distortion caused by the press-fitting is inhibited since the inner periphery of the external screw 25 and the portion in which the stress is caused by the press-fitted portion 34 are deviated from each other in the axial direction. Thus, even if the bush 31 is press-fitted to the inside of the inside-outside communication hole 24, the deformation of the external screw 25 is avoided. Thus, trouble can be avoided when the pipes 6, 7 are screwed.

The present embodiment has the characteristics (1) to (3) of the FIG. 1 embodiment and can exert the effects of the characteristics (1) to (3).

Moreover, the common rail 1 according to the present embodiment employs the structure in which the end of the orifice of the bush 31 (end of the smallest diameter orifice 32 in the present embodiment) is located near the pressure accumulation chamber 23. By increasing a volume at the end of the orifice, an effect of weakening the reflection of the pressure pulsation can be obtained. By providing the end of the orifice of the bush 31 near the pressure accumulation chamber 23 as in the present embodiment, the effect of attenuating the pressure pulsation reflected in the injector pipe 7 can be further improved.

Next, a common rail according to another example embodiment of the present invention will be explained in reference to FIG. 6.

As described above, in the case where the end of the orifice of the bush 31 is provided near the pressure accumulation chamber 23 in order to improve the effect of attenuating the pressure pulsation, the bush 31 has to be press-fitted into the deep side (pressure accumulation chamber 23 side) of the inside-outside communication hole 24. In this case, as described above, by forming the pressure release periphery 39 on the pipe joint 21 side of the inside-outside communication hole 24, the press-fitting work of the bush 31 is facilitated.

In the case where the pressure release periphery 39 is provided on the pipe joint 21 side, each one of the pipes 6, 7 prevents the bush 31 from thoroughly coming off when the fuel discharge pressure, vibration or the like moves the bush 31, which is press-fitted in the press-fitting periphery 40, in a direction causing coming off of the bush 31. However, in this case, there is a possibility that the press-fitted portion 34 moves into a range of the pressure release periphery 39 and a clearance extending in the axial direction is generated between the inner peripheral face of the inside-outside communication hole 24 and the outer peripheral face of the bush 31. If the clearance extending in the axial direction is generated between the inner peripheral face of the inside-outside communication hole 24 and the outer peripheral face of the bush 31, the orifice provided in the bush 31 loses its effect.

In the present embodiment, the pressure release periphery 39 having the larger inner diameter than the outer diameter of the press-fitted portion 34 is provided on the insertion side of the bush 31 (side connected with each of the pipes 6, 7) in the inside-outside communication hole 24. In order to avert the above-described trouble, axial length X1 of the press-fitted portion 34 is set larger than length X2 between the end of each of the pipes 6, 7 attached to the pipe joint 21 and the end of the press-fitting periphery 40 on a side closer to the pressure release periphery 39.

In order to determine the length X2 in a state in which the pipes 6, 7 are not attached, the length X2 may be replaced with the axial length of the pressure release periphery 39 including a diameter changing range between the pressure release periphery 39 and the press-fitting periphery 40.

Figure 5:
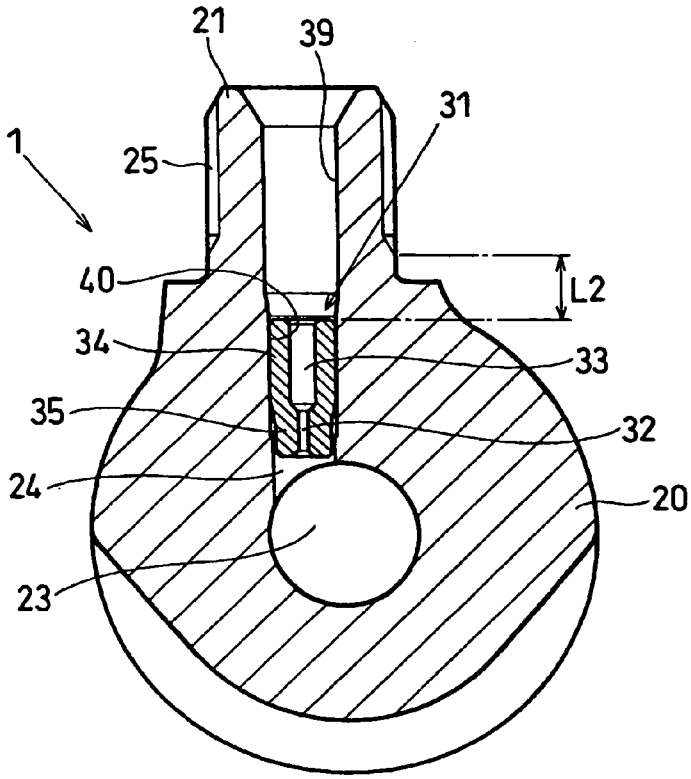
FIG. 5 is a cross-sectional view showing a common rail according to another example embodiment of the present invention.

By extending the press-fitted portion 34 of the bush 31 in the axial direction, the relation X1>X2 is satisfied while ensuring the large length of the pressure release periphery 39 like the FIG. 5 embodiment.

In other words, axial overlapping length Y1 between the press-fitted portion 34, which has not moved after press-fitting, and the press-fitting periphery 40 is larger than axial length Y2 between the end of the bush 31, which has not moved after the press-fitting, and the end of each of the pipes 6, 7.

Thus, even if the bush 31 press-fitted in the press-fitting periphery 40 moves due to a certain cause in a direction in which the bush 31 comes off and strikes against the end of each of the pipes 6, 7, the state in which the press-fitted portion 34 and the press-fitting periphery 40 overlap each other in the radial direction is maintained. Even if the bush 31 moves in the direction causing the coming off of the bush 31 because of a certain cause, the press-fitted portion 34 overlaps with the press-fitting diameter along the axial direction over at least the length (X1−X2).

Thus, even if the bush 31 moves in a direction causing the coming off of the bush 31 due to some causes and the bush 31 reaches the maximum displacement to strike the end of each one of the pipes 6, 7, the overlap between the press-fitted portion 34 and the press-fitting periphery 40 is maintained. Therefore, a problem of generation of the clearance extending in the axial direction between the inner peripheral face of the inside-outside communication hole 24 and the outer peripheral face of the bush 31 can be averted.

Even if the bush 31 press-fitted in the press-fitting periphery 40 moves in the direction causing the coming off of the bush 31, the effect of the orifice formed in the bush 31 such as the smallest diameter orifice 32 is not lost.

Next, a common rail according to another example embodiment of the present invention will be explained in reference to FIG. 7.

Figure 6:
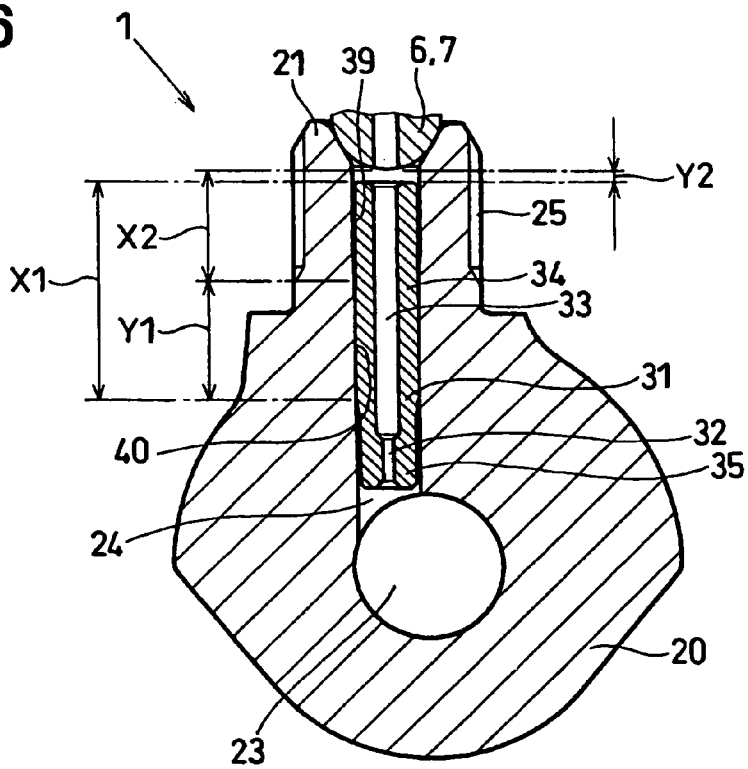
FIG. 6 is a cross-sectional view showing a common rail according to another example embodiment of the present invention.

In the FIG. 6 embodiment, by satisfying the relation X1>X2, loss of the effect of the orifice formed in the bush 31 is prevented even if the bush 31 moves in the direction causing the coming off of the bush 31.

Figure 7:
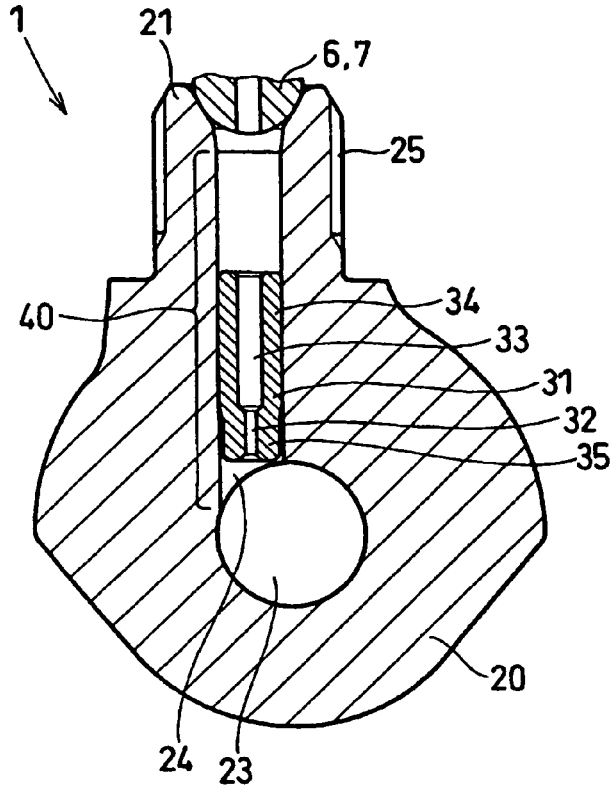
FIG. 7 is a cross-sectional view showing a common rail according to another example embodiment of the present invention.

As shown in FIG. 7, the inside-outside communication hole 24 according to the present embodiment is provided such that the press-fitting periphery 40 having the diameter smaller than the diameter of the press-fitted portion 34 extends to proximity of the end of the pipe joint 21 and no pressure release periphery 39 is provided on the insertion side of the bush 31. Thus, even if the bush 31 press-fitted into the press-fitting periphery 40 moves in the direction causing the coming off of the bush 31 and the bush 31 strikes against one of the pipes 6, 7, the overlap between the press-fitted portion 34 and the press-fitting periphery 40 is maintained. As a result, the effect of the orifice formed in the bush 31 such as the smallest diameter orifice 32 is not lost like the FIG. 6 embodiment.

Like the present embodiment, the FIG. 1 embodiment does not provide the pressure release periphery 39 on the insertion side of the bush 31 in the inside-outside communication hole 24 but the press-fitting periphery 40 extends to the proximity of the end of the pipe joint 21. Therefore, the effect of the orifice formed in the bush 31 such as the smallest diameter orifice 32 is not lost even if the bush moves in the direction causing the coming off of the bush 31 in the FIG. 1 embodiment as well.

Next, a common rail according to another example embodiment of the present invention will be explained in reference to FIGS. 8 to 9BB.

In the FIG. 6 embodiment, by extending the press-fitted portion 34 of the bush 31 in the axial direction, the relation X1>X2 is satisfied while ensuring the large length of the pressure release periphery 39 like the FIG. 5 embodiment.

Figure 8:
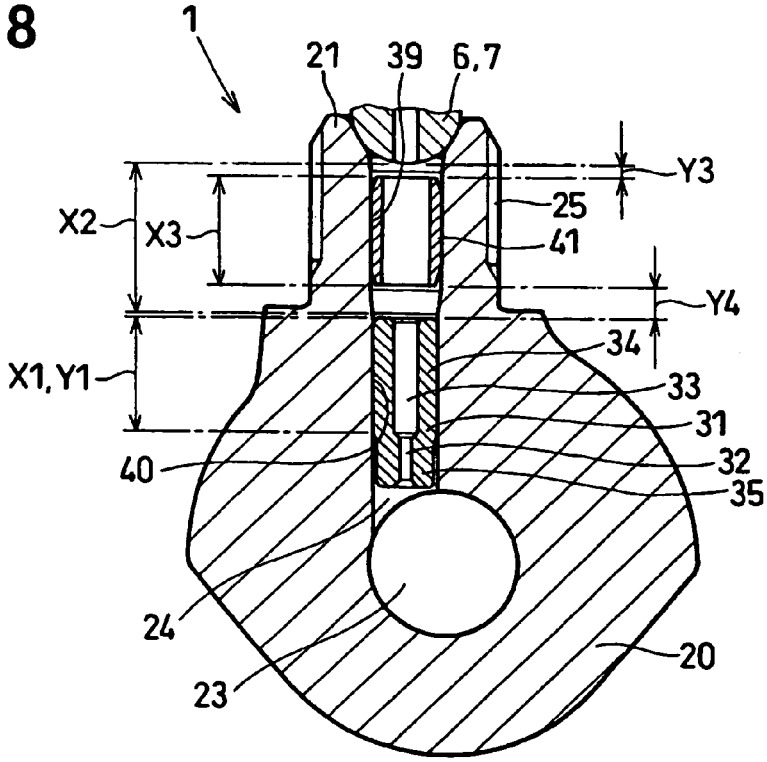
FIG. 8 is a cross-sectional view showing a common rail according to another example embodiment of the present invention.

In the present embodiment, a prevention member 41 for preventing the coming off of the bush 31 is provided inside the pressure release periphery 39 as shown in FIG. 8. The prevention member 41 is held inside the pressure release periphery 39 but does not hinder the flow of the fuel passing through the pressure release periphery 39. The prevention member 41 can contact one of the pipes 6, 7 and the bush 31 in the axial direction.

Figure 9A:
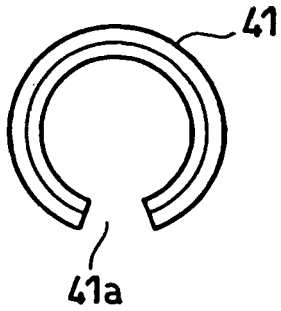
FIG. 9A is a front view showing an example of a prevention member according to the FIG. 8 embodiment.

Examples of the prevention member 41 will be explained in reference to FIGS. 9A to 9BB. The prevention member 41 shown in FIGS. 9A and 9AA is a cylindrical spring pin formed with a slit 41*a* extending in the axial direction such that the prevention member 41 has a C-shaped cross-section. The spring pin 41 is formed such that an outer diameter in a free-length state (state in which no external load is applied) is much larger than the inner diameter of the pressure release periphery 39. If the spring pin 41 is fitted into the pressure release periphery 39, the spring pin 41 is held inside the pressure release periphery 39 because of resilience of the spring pin 41.

Figure 9B:
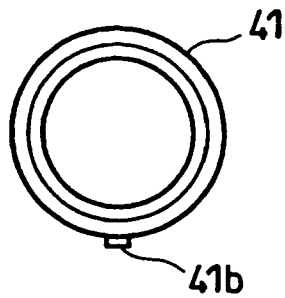
FIG. 9B is a front view showing another example of the prevention member according to the FIG. 8 embodiment.
Figure 9A:
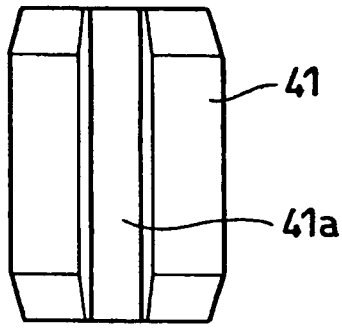
Figure 9B:
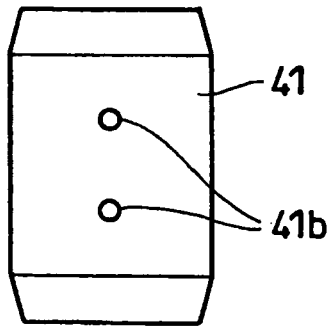

The prevention member 41 shown in FIGS. 9B and 9BB is a caulking bush in the shape of a cylinder. The caulking bush 41 is formed with one or more protrusions 41*b*. If the caulking bush 41 is fitted into the pressure release periphery 39, the protrusions 41*b* tightly strike against the face of the pressure release periphery 39. Thus, the caulking bush 41 is held inside the pressure release periphery 39.

In the present embodiment, the pressure release periphery 39 having the inner diameter larger than the outer diameter of the press-fitted portion 34 is provided on the insertion side of the bush 31 in the inside-outside communication hole 24 and the prevention member 41 for preventing the coming off of the bush 31 is located inside the pressure release periphery 39. The axial length X1 of the press-fitted portion 34 is set larger than the difference between the length X2 from the end of one of the pipes 6, 7 attached to the pipe joint 21 to the end of the press-fitting periphery 40 on the side closer to the pressure release periphery 39 and the axial length X3 of the prevention member 41 (X1>X2−X3).

In order to determine the length X2 in a state in which the pipes 6, 7 are not attached, the length X2 may be replaced with the axial length of the pressure release periphery 39 including a diameter changing range between the pressure release periphery 39 and the press-fitting periphery 40.

In other words, overlapping axial length Y1 between the press-fitted portion 34, which has not moved after press-fitting, and the press-fitting periphery 40 is set larger than summation of the axial length Y3 between the prevention member 41 and the end of one of the pipes 6, 7 and the axial length Y4 between the prevention member 41 and the end of the bush 31 (Y1>Y3+Y4).

Thus, even if the bush 31 press-fitted in the press-fitting periphery 40 moves due to a certain cause in a direction causing the coming off of the bush 31 and strikes against the end of each of the pipes 6, 7 through the prevention member 41, the state in which the press-fitted portion 34 overlaps with the press-fitting periphery 40 in the radial direction is maintained. Even if the bush 31 moves in the direction causing the coming off of the bush 31 because of a certain cause, the press-fitted portion 34 overlaps with the press-fitting periphery 40 along the axial direction over at least the length (X1−(X2−X3)).

Thus, even if the bush 31 moves in the direction causing the coming off of the bush 31 due to some causes and reaches the maximum displacement at which the bush 31 contacts the end of one of the pipes 6, 7 through the prevention member 41, the overlap between the press-fitted portion 34 and the press-fitting periphery 40 is maintained. Therefore, a problem of generation of an axially extending clearance between the inner peripheral face of the inside-outside communication hole 24 and the outer peripheral face of the bush 31 can be averted.

Even if the bush 31 press-fitted in the press-fitting periphery 40 moves in the direction causing the coming off of the bush 31, the effect of the orifice formed in the bush 31 such as the smallest diameter orifice 32 is not lost.

Figure 10:
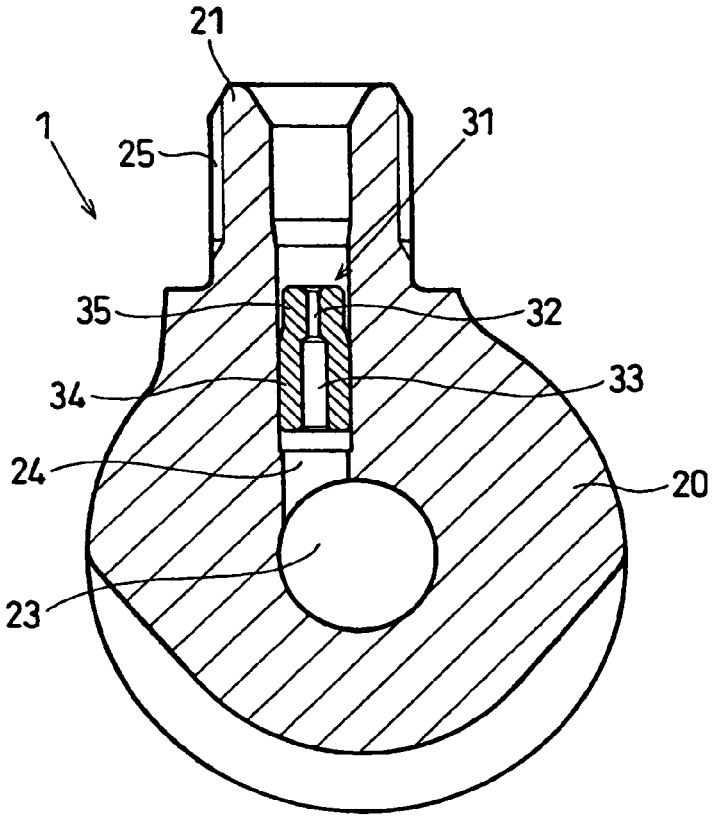
FIG. 10 is a cross-sectional view showing a common rail according to another example embodiment of the present invention.

In the above-described example embodiments, the smallest diameter orifice 32 of the bush 31 is provided on the pressure accumulation chamber 23 side of the press-fitted portion 34. Alternatively, the press-fitting direction of the bush 31 may be reversed such that the press-fitted portion 34 is located on the pressure accumulation chamber 23 side of the smallest diameter orifice 32 of the bush 31 as shown in FIG. 10.

Figure 11:
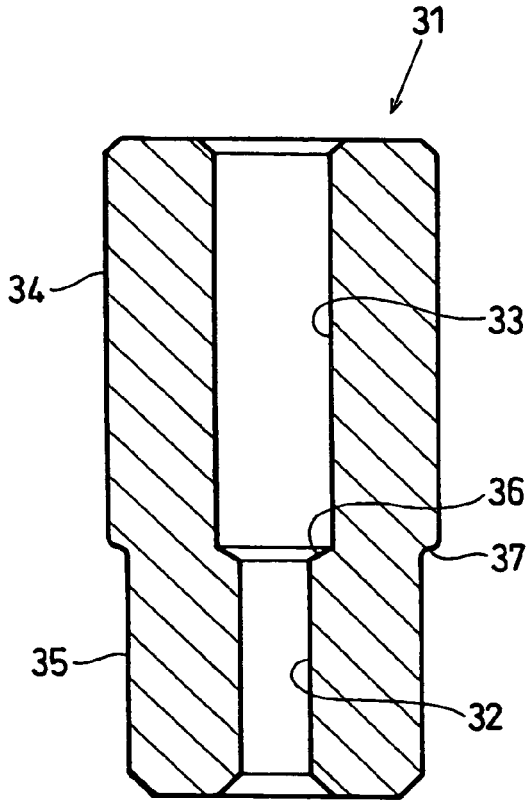
FIG. 11 is a longitudinal cross-sectional view showing a bush according to another example embodiment of the present invention.

In the above-described example embodiments, the outer peripheral face 37 of the transitional portion 36 between the smallest diameter orifice 32 and the adjacent orifice 33 is formed as the tapered face. Alternatively, the outer peripheral face 37 may be formed as a stepped portion as shown in FIG. 11. Alternatively, the outer peripheral face 37 may be formed in the shape of a curved face.

Figure 12:
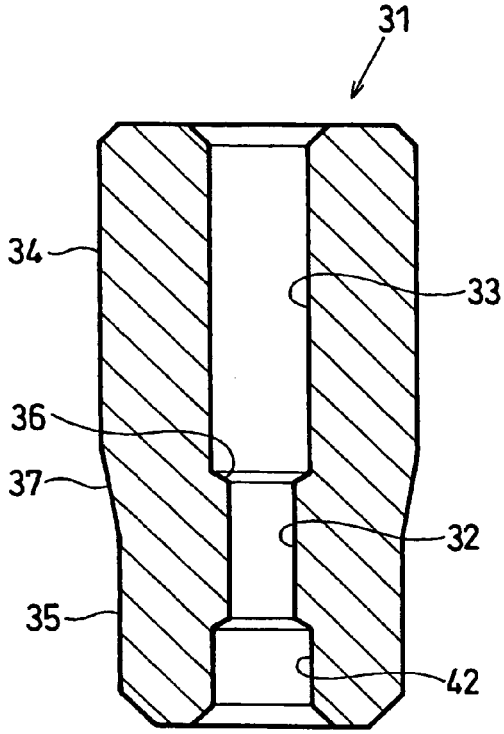
FIG. 12 is a longitudinal cross-sectional view showing a bush according to another example embodiment of the present invention.

In the above-described embodiments, the two steps of the orifices (smallest diameter orifice 32 and adjacent orifice 33) are formed in the bush 31. Alternatively, three or more steps of the orifices may be formed on the inner periphery of the bush 31. For example, a second adjacent orifice 42 may be formed inside the non-press-fitted portion 35 as shown in FIG. 12.

In the above described embodiments, the common rail 1 is a forged type formed by forging the rail main body 20, the pipe joints 21 and the stays 22 by a forging process. Alternatively, part or entity of the rail main body 20, the pipe joints 21 and the stays 22 may be produced independently and may be integrated by a bonding technology such as welding process to produce a bonded common rail 1.

Figure 13:
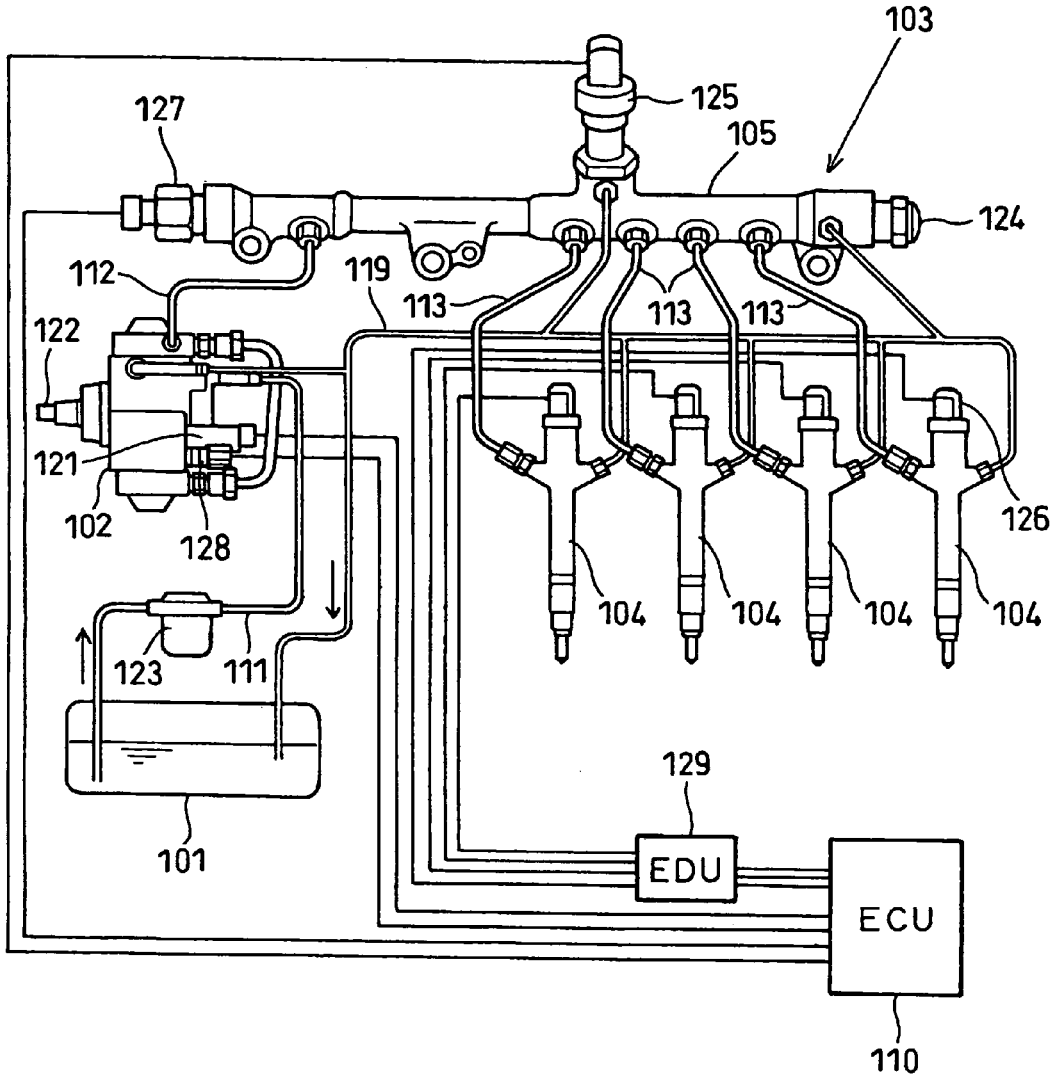
FIG. 13 is a schematic diagram showing a common rail fuel injection system according to another example embodiment of the present invention.

Next, a common rail fuel injection system according to another example embodiment of the present invention will be explained in reference to drawings. A fuel injection device for an internal combustion engine according to the present embodiment shown in FIG. 13 is mounted in an engine room of a vehicle such as an automobile. For example, the fuel injection device is a common rail fuel injection system (pressure accumulation fuel injection device) known as a fuel injection system for an internal combustion engine such as a diesel engine (multi-cylinder diesel engine).

The common rail fuel injection system has a supply pump (fuel injection pump, fuel supply pump) 102 incorporating a feed pump for drawing low-pressure fuel from a fuel tank 101, a common rail 103, to which high-pressure fuel is introduced from a discharge hole of the supply pump 102, and multiple injectors 104 (four injectors 104 in the present embodiment), i.e., fuel injection valves for an engine, to which the high-pressure fuel is distributed from respective fuel outlets of the common rail 103. The fuel injection system injects and supplies the high-pressure fuel accumulated in the common rail 103 into combustion chambers of respective cylinders of the engine through the injectors 104.

The supply pump 102 is a fuel supply pump (high-pressure supply pump) having two or more pressure-feeding systems, i.e., pump elements, for pressurizing the low-pressure fuel, which is suctioned from the fuel tank 101 through a low-pressure pump pipe 111. The supply pump 102 controls a fuel discharge amount of the two or more pressure-feeding systems by regulating fuel suction amount suctioned into pressurization chambers with a single electromagnetic valve 121.

The supply pump 102 has the feed pump of a known structure (not shown), a cam (not shown), two or more plungers (not shown), and a cylinder head. The cam is driven by a pump drive shaft 122 (camshaft or the like). Each plunger is driven by the cam to linearly reciprocate between a top dead center and a bottom dead center. The cylinder head is fixed to a pump housing and is formed with two or more pressurization chambers inside.

The feed pump is a low-pressure feed pump that draws fuel from the fuel tank 101 when the pump drive shaft 122 rotates in accordance with rotation of the crankshaft of the engine. A fuel filter 123 is provided in the low-pressure pump pipe 111 connecting the fuel tank 101 with a fuel suction hole of the feed pump. The supply pump 102 pressurizes the low-pressure fuel, which is suctioned into the two or mode pressurization chambers from the fuel tank 101 through the low-pressure pump pipe 111, the feed pump and a fuel suction passage, as the plungers reciprocate inside the cylinder head.

The supply pump 102 is formed with a leak port to prevent the fuel temperature inside the supply pump 102 from increasing to high temperature. The leak fuel from the supply pump 102 is returned to the fuel tank 101 through a relief pipe 119. The electromagnetic valve 121 for metering the fuel suction amount suctioned into the two or more pressurization chambers is located in the fuel suction passage, which is formed inside the supply pump 102 and extends from the feed pump to the two or more pressurization chambers. The electromagnetic valve 121 is electronically controlled by pump drive current applied by an engine control unit (ECU) 110.

The common rail 103 is a pressure accumulation vessel for accumulating the high-pressure fuel in accordance with the fuel injection pressure. The common rail 103 is connected with a discharge hole of the supply pump 102 through a high-pressure pump pipe 112 and is connected with the injectors 104 through multiple injector pipes 113. The common rail 103 is formed with first and second leak ports. Leak fuel from the common rail 103 is returned to the fuel tank 101 through the relief pipe 119.

A pressure limiter 124 is fluid-tightly attached to the first leak port of the common rail 103. The pressure limiter 124 is a pressure safety valve that opens when the inner pressure of the common rail 103 (common rail pressure) exceeds limit set pressure to limit the common rail pressure to or below the limit set pressure. A pressure reduction valve 125 is fluid-tightly attached to the second leak port of the common rail 103. The pressure reduction valve 125 is an electromagnetic valve electronically controlled by pressure reduction valve drive current applied by the ECU 110. The pressure reduction valve 125 has excellent pressure reduction performance for quickly reducing the common rail pressure from high pressure to low pressure, for example, when the engine is decelerated or stopped.

The multiple injectors 104 mounted in the respective cylinders of the engine are electromagnetic fuel injection valves. Each injector 104 has a fuel injection nozzle connected to a downstream end of one of multiple pipes 113 branching from the common rail 103 with respect to the fuel flow direction for performing fuel injection, an electromagnetic valve 126 for driving a nozzle needle accommodated in the fuel injection nozzle in a valve opening direction, and the like. Each injector 104 is formed with a leak port. The leak fuel from the injectors 104 is also returned to the fuel tank 101 through the relief pipe 119.

The ECU 110 has a microcomputer including a CPU for performing control processing and calculation processing, a storage device (memory such as ROM or RAM) for storing various types of programs and data, an input circuit (input section) and an output circuit (output section). An electric signal from a fuel pressure sensor (common rail pressure sensor) 127 attached to the common rail 103 and sensor signals from various sensors are inputted to the microcomputer after undergoing A/D conversion at an A/D converter. The input section of the microcomputer is connected with a crank angle sensor, an accelerator position sensor, a coolant temperature sensor, a fuel temperature sensor 128 and the like as well as the common rail pressure sensor 127. The microcomputer functions also as a rotation speed sensor for sensing engine rotation speed NE by measuring time intervals of NE signal pulses outputted from the crank angle sensor.

If an ignition switch (not shown) is turned on (IG•ON), the ECU 110 electronically controls the electromagnetic valve 121 of the supply pump 102, the pressure reduction valve 125 of the common rail 103, the electromagnetic valves 126 of the injectors 104 and the like based on the control programs stored in the memory. A pump drive circuit (not shown) is connected between the output section of the microcomputer and the electromagnetic valve 121 of the supply pump 102. A pressure reduction valve drive circuit is connected between the output section of the microcomputer and the pressure reduction valve 125 of the common rail 103. An injector drive circuit (EDU) 129 is connected between the output section of the microcomputer and the electromagnetic valves 126 of the injectors 104.

Figure 14:
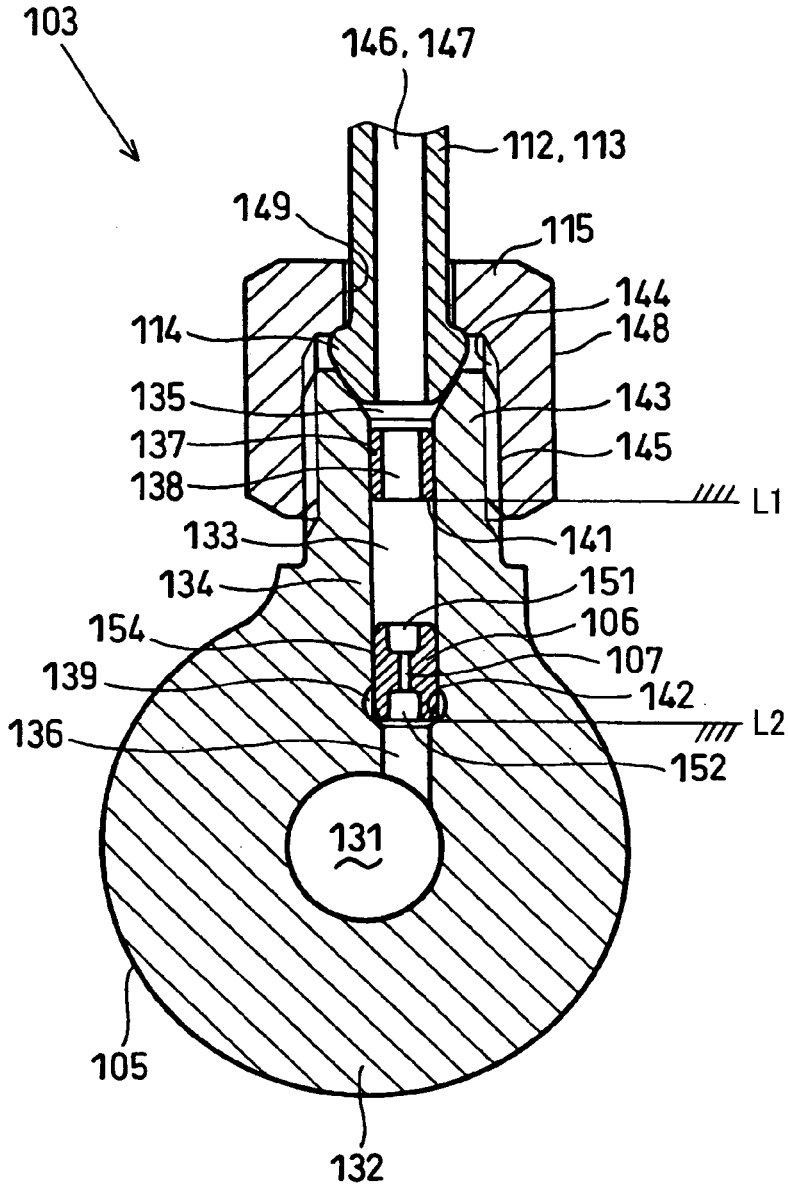
FIG. 14 is a cross-sectional view showing a common rail according to the FIG. 13 embodiment.

As shown in FIG. 14, the common rail 103 has a rail main body 105 in the shape of a cylindrical pipe for accumulating the super-high-pressure fuel inside and multiple orifice pistons 106 incorporated in the rail main body 105. The rail main body 105 is formed with functional component connection portions for connecting the functional components such as the pressure limiter 124, the pressure reduction valve 125 and the common rail pressure sensor 127 as shown in FIG. 13. The rail main body 105 is a forged product or a press-molded product made of a low-hardness material such as low-carbon crude steel. The rail main body 105 has a cylindrical section 132 formed with a pressure accumulation chamber 131 inside. The rail main body 105 is formed with multiple cylinder portions 134 respectively formed with inside-outside communication holes 133 inside.

The pressure accumulation chamber 131 is formed inside the cylindrical section 132 such that the pressure accumulation chamber 131 extends from the functional component connection portion of the pressure reduction valve 125 shown on the left side of FIG. 13 toward the functional component connection portion of the pressure limiter 124 shown on the right side of FIG. 13 substantially in the direction of an axis of the cylindrical section 132. The cylindrical section 132 is provided such that the cylindrical section 132 circumferentially surrounds the pressure accumulation chamber 131. The pressure accumulation chamber 131 is an internal space having a circular cross-section for temporarily accumulating the high-pressure fuel discharged from the discharge hole of the supply pump 102 and for distributing the accumulated high-pressure fuel to the injectors 104.

The multiple inside-outside communication holes 133 are formed in the cylinder portions 134 respectively. A central axis of each inside-outside communication hole 133 is slightly deviated from the central axis of the pressure accumulation chamber 131 outward in a radial direction of the pressure accumulation chamber 131. By offsetting the central axis of the inside-outside communication hole 133 with respect to the central axis of the pressure accumulation chamber 131, an opening of the inside-outside communication hole 133 opening in a passage wall face of the pressure accumulation chamber 131 is formed in the shape of an ellipse and a circumference of the opening is lengthened. Thus, stress concentration in an edge of the opening can be alleviated and compression strength of the rail main body 105 can be improved.

The inside-outside communication holes 133 are communication passages that have circular cross-sections and are formed by hole making process at suitable intervals with respect to an axial direction of the cylindrical section 132 of the rail main body 105. The inside-outside communication holes 133 communicating with an exterior, specifically, the inside-outside communication holes 133 communicating with interior of the injectors 104 mounted in the respective cylinders of the engine through the pipes 113, are formed by hole making process at a constant interval with respect to the axial direction of the cylindrical section 132 of the rail main body 105. The inside-outside communication hole 133 communicating with the discharge hole of the supply pump 102 through the pipe 112 is formed by hole making process on the sensor side (left side in FIG. 13) with respect to the axial direction of the cylindrical section 132 of the rail main body 105.

As shown in FIG. 14, the rail main body 105 is formed with first opening ends (first fuel ports) 135 and second opening ends (second fuel ports) 136. Each first opening end 135 opens outward on one side (upper side in FIG. 14) of each cylinder portion 134 with respect to an axial direction of the inside-outside communication hole 133 of the cylinder portion 134. Each first opening end 135 is formed in the shape of a truncated circular cone. Each second opening end 136 opens into the pressure accumulation chamber 131 on the other side (lower side in FIG. 14) of each cylinder portion 134 with respect to the axial direction of the inside-outside communication hole 133 of the cylinder portion 134. Each second opening end 136 is formed in the shape of a circle. The first fuel port 135 of each cylinder portion 134 is formed with a chamfered face in the shape of a circular cone such that its inner diameter gradually increases from the one end of the inside-outside communication hole 133 of the cylinder portion 134 toward the outside.

Multiple stoppers 137 are held and fixed to the hole wall faces of the inside-outside communication holes 133 near the first fuel ports 135 of the cylinder portions 134 through press-fitting process or the like respectively. A first annular wall face 141 of each stopper 137 on the pressure accumulation chamber 131 side provides a first limiting face L1 (first stopper face) for limiting an axial moving range (maximum stroke, maximum displacement) of each orifice piston 106 at the time when the orifice piston 106 moves relative to each cylinder portion 134. Each stopper 137 is formed in a cylindrical shape. Each stopper 137 is formed with a penetration hole 138 extending straight in the axial direction of the stopper 137. Each penetration hole 138 provides a communication passage connecting each first fuel port 135 with each inside-outside communication hole 133.

The second fuel port 136 of each cylinder portion 134 has an inner diameter smaller than the inner diameter of the inside-outside communication hole 133. Therefore, an annular concave portion 139 having a stepped portion in the shape of a ring is formed near the second fuel port 136 of each cylinder portion 134. The annular concave portion 139 has an inner diameter larger than the inner diameter of each inside-outside communication hole 133. A step face 142 (second annular end face) of the stepped portion facing outward provides a second limiting face L2 (second stopper face) for limiting the axial moving range (maximum stroke, maximum displacement) of each orifice piston 106 at the time when the orifice piston 106 moves relative to each cylinder portion 134 of the rail main body 105.

One side (upper side in FIG. 14) of each cylinder portion 134 with respect to the axial direction of the inside-outside communication hole 133 protrudes outward from the outer peripheral face of the cylindrical section 132 in a radial direction of the cylindrical section 132. The other end (lower end) of the cylinder portion 134 with respect to the axial direction of the inside-outside communication hole 133 is formed integrally with the cylinder wall portion of the cylindrical section 132. The circular pipe portions radially protruding from the outer peripheral face of the cylindrical section 132 function as pipe fastening portions 143 (pipe connectors) for fastening connection heads 114 formed in the shape of flanges at the downstream end of the pipe 112 or at the upstream ends of the pipes 113 by using pipe fastening nuts 115.

The outer periphery of each pipe connector 143 is formed with an outer peripheral screw (external screw) 145 screwed with an inner peripheral screw (internal screw) 144 formed on an inner periphery of the pipe fastening nut 115. A fuel passage 146 is formed inside the pipe 112 for introducing the high-pressure fuel into the pressure accumulation chamber 131 from the discharge hole of the supply pump 102 through the inside-outside communication hole 133. A fuel passage 147 is formed inside each pipe 113 for supplying the high-pressure fuel into each injector 104 from the inside of the pressure accumulation chamber 131 through each inside-outside communication hole 133.

The pipe fastening nut 115 is formed with a hexagonal engaging portion 148 engageable with a fastening tool. The pipe fastening nut 115 is formed with an insertion hole 149, through which the downstream end of the pipe 112 or the upstream end of the pipe 113 is inserted. An edge of the opening of the insertion hole 149 provides an annular locking portion (limiting face) for locking a stepped portion on a backside of the connection head 114 of each of the pipes 112, 113. The inner peripheral screw 144 of the pipe fastening nut 115 is fitted with the outer peripheral screw 145 of the pipe fastening portion 143 and is screwed to the outer peripheral screw 145 of the pipe fastening portion 143 in a state in which the locking portion of the pipe fastening nut 115 locks the stepped portion of the connection The high-pressure fuel flowing into the orifice piston 106 from the inside-outside communication hole 133 of the cylinder portion 134 flows into the stopper 137 through the second large diameter hole 152, the orifice 107 and the first large diameter hole 151 formed inside the orifice piston 106. The high-pressure fuel flowing into the stopper 137 flows into the first fuel port (outlet port) 135 as an opening end of the cylinder portion 134 of the rail main body 105 of the common rail 103 through the penetration hole 138 of the stopper 137. The high-pressure fuel flowing into the first fuel port 135 flows into the injector 104 mounted in the first cylinder through the fuel passage 147 formed inside the pipe 113. The high-pressure fuel is injected into the combustion chamber of the first cylinder from the injector 104.

Thus, in the present embodiment, the high-pressure fuel accumulated in the pressure accumulation chamber 131 of the rail main body 105 of the common rail 103 is injected and supplied into the combustion chamber of the first cylinder of the engine while the electromagnetic valve 126 of the injector 104 is energized and the nozzle needle opens the multiple injection holes formed in the nozzle body tip end of the fuel injection nozzle. If the electromagnetic valves 126 of the injectors 104 mounted in the cylinders (second to fourth cylinders) other than the first cylinder are energized in series, the high-pressure fuel accumulated in the pressure accumulation chamber 131 of the rail main body 105 of the common rail 103 is distributed into the injectors 104 mounted in the second to fourth cylinders and is supplied into the combustion chambers of the second to fourth cylinders of the engine through the injection in series. Thus, the engine is operated.

As described above, in the common rail 103 according to the present embodiment, as shown in FIG. 14, the orifice pistons 106 are slidably incorporated in the inside-outside communication holes 133 of the multiple cylinder portions 134 of the rail main body 105 respectively. The orifice 107 is formed inside each orifice 12.0 mm. The orifice 107 penetrates straight through the orifice piston 106 on the central axis of the orifice piston 106.

Each orifice piston 106 is formed with a first large diameter hole 151 upstream of (or downstream of) the orifice 107 with respect to the flow direction of the fuel and with a second large diameter hole 152 downstream of (or upstream of) the orifice 107 with respect to the flow direction of the fuel. The first and second large diameter holes 151, 152 are communication passages for connecting the orifice 107 with the inside-outside communication hole 133 upstream and downstream of the orifice piston 106 with respect to the flow direction of the fuel. Each of the first and second large diameter holes 151, 152 has an inner diameter (hole diameter ranging from 2.0 to 6.5 mm, for example) larger than the restrictor diameter of the orifice 107. The first large diameter hole 151 opens in the first annular end face of the orifice piston 106 toward the first limiting face 141 (L1) of the stopper 137 to define a first fluid port. The second large diameter hole 152 opens in the second annular end face of the orifice piston 106 toward the second limiting face 142 (L2) of the cylinder portion 134 to define a second fluid port.

Figure 15A:
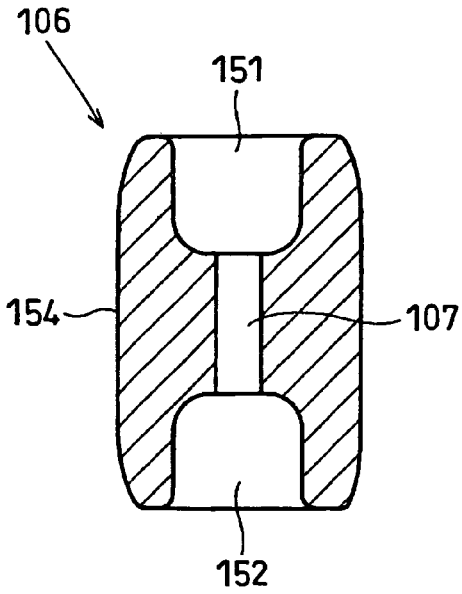
FIG. 15A is a longitudinal cross-sectional view showing an example of an orifice piston according to the FIG. 13 embodiment.
Figure 15B:
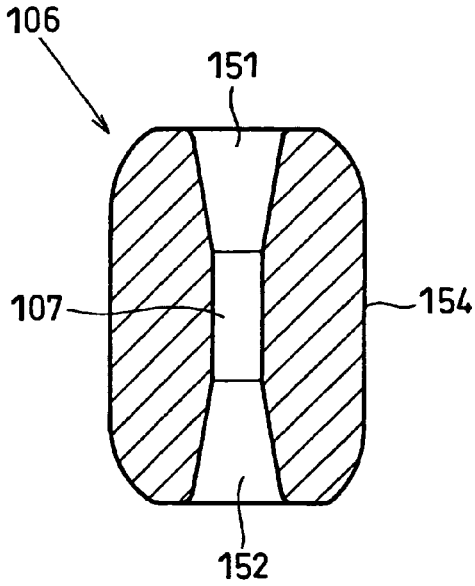
FIG. 15B is a longitudinal cross-sectional view showing another example of the orifice piston according to the FIG. 13 embodiment.

Since the first large diameter hole 151 has an inner diameter larger than that of the orifice 107, the first large diameter hole 151 communicates with the orifice 107 through an annular first stepped portion (first stepped face). Since the second large diameter hole 152 has a larger inner diameter than that of the orifice 107, the second large diameter hole 152 communicates with the orifice 107 through an annular second stepped portion (second stepped face). In the present embodiment, each of the first and second large diameter holes 151, 152 has a circular cross section with an inner diameter substantially constant from an opening in each end face of the orifice piston 106 toward the orifice 107 as shown in FIG. 15A. Alternatively, as shown in FIG. 15B, each of the first and second large diameter holes 151, 152 may be formed as a tapered hole (hole in the shape of a truncated cone) with an inner diameter gradually decreasing from the opening toward the orifice 107.

Each orifice piston 106 has a sliding portion that surrounds the periphery of the orifice 107 and that is slidably held by a hole wall face (inner peripheral face, sliding face) of each cylinder portion 134 of the rail main body 105. Each orifice piston 106 has a first sliding portion extending upstream (or downstream) from the sliding portion with respect to the fuel flow direction and a second sliding portion extending downward (or upward) from the sliding portion with respect to the fuel flow direction. The first and second sliding portions surround peripheries of the first and second large diameter holes 151, 152 respectively. The first and second sliding portions are slidably held by the sliding face of each cylinder portion 134.

Outer peripheral faces of the sliding portion and the first and second sliding portions of each orifice piston 106 define a sliding face 154 capable of sliding on the sliding face of each cylinder portion 134 in the axial direction of the inside-outside communication hole 133 of the cylinder portion 134. The sliding face 154 of each orifice piston 106 is longer than the axial passage length of each orifice 107 in the axial direction by approximately the axial passage length of the first and second large diameter holes 151, 152. A predetermined (minimum) clearance necessary for enabling each orifice piston 106 to linearly reciprocate in a sliding manner in the inside-outside communication hole 133 of each cylinder portion 134 in a slidable range (movable range, stroke range) of the orifice piston 106 from the first limiting face 141 (L1) to the second limiting face 142 (L2) is provided between the sliding face 154 of the orifice piston 106 and the sliding face of the cylinder portion 134.

An outer peripheral corner of each axial end of the orifice piston 106 is chamfered into a rounded shape or a conical shape for facilitating the reciprocal and linear movement (sliding movement) of the orifice piston 106 in the inside-outside communication hole 133. The first annular end face of each orifice piston 106 provides a first contact face capable of contacting the first limiting face 141 (L1) of the stopper 137 press-fitted into the inside-outside communication hole 133 of each cylinder portion 134 when the orifice piston 106 moves relative to the cylinder portion 134. The second annular end face of each orifice piston 106 provides a second contact face capable of contacting the second limiting face 142 (L2) integrally formed with the inside-outside communication hole 133 of the cylinder portion 134 when the orifice piston 106 moves relative to the cylinder portion 134.

The first contact face and the first stepped face between the first large diameter hole 151 and the orifice 107 of each orifice 106 function as a first pressure receiving face for receiving the fuel pressure. The second contact face and the second stepped face between the orifice 107 and the second contact face of each orifice piston 106 function as a second pressure receiving face for receiving fuel pressure.

Next, a function of the common rail fuel injection system according to the present embodiment will be explained in reference to drawings.

The high-pressure fuel discharged from the discharge hole of the supply pump 102 flows from the fuel passage 146 formed inside the pipe 112 into the first fuel port (inlet port) 135 as the opening end of the cylinder portion 134 of the rail main body 105 of the common rail 103 through the pipe 112. The high-pressure fuel flowing into the first fuel port 135 flows into the inside-outside communication hole 133 of the cylinder portion 134 through the penetration hole 138 formed in the stopper 137, which is press-fitted to the proximity of the opening end of the inside-outside communication hole 133 of the cylinder portion 134.

The high-pressure fuel flowing into the inside-outside communication hole 133 of the cylinder portion 134 acts on the first pressure receiving face of the orifice piston 106 slidably accommodated in the inside-outside communication hole 133. Since the fuel pressure acts on the first pressure receiving face of the orifice piston 106, the orifice piston 106 moves downward in FIG. 14 and the second contact face of the orifice piston 106 is pressed against the second limiting face 142 (L2) at the stepped portion formed integrally with the inside-outside communication hole 133 of the cylinder portion 134. Thus, the position of the orifice piston 106 is limited at a default position shown in FIG. 14.

The high-pressure fuel flowing into the orifice piston 106 from the inside-outside communication hole 133 of the cylinder portion 134 flows into the second fuel port 136 of the cylinder portion 134 through the first large diameter hole 151, the orifice 107 and the second large diameter hole 152 formed in the orifice piston 106. The high-pressure fuel flowing into the second fuel port 136 of the cylinder portion 134 flows into the pressure accumulation chamber 131 formed inside the cylindrical section 132 of the rail main body 105 and is temporarily accumulated in the pressure accumulation chamber 131.

If the injection timing of the injector 104 mounted in the first cylinder out of the multiple cylinders of the engine is reached, energization of the electromagnetic valve 126 of the injector 104 is started. Thus, the nozzle needle opens multiple injection holes formed at the tip end of the nozzle body of the fuel injection nozzle. If the injector 104 mounted in the first cylinder opens, the high-pressure fuel accumulated in the pressure accumulation chamber 131 of the cylindrical section 132 of the rain main body 105 flows into the second fuel port 136 of the cylinder portion 134 corresponding to the first cylinder. The high-pressure fuel flowing into the second fuel port 136 of the cylinder portion 134 acts on the second pressure receiving face of the orifice piston 106. Since the fuel pressure acts on the second pressure receiving face of the orifice piston 106, the orifice piston 106 moves upward in FIG. 14 and the first contact face of the orifice piston 106 is pressed against the first limiting face 141 (L1) of the stopper 137. Thus, the position of the orifice piston 106 is limited at a full lift position.

The high-pressure fuel flowing into the orifice piston 106 from the inside-outside communication hole 133 of the cylinder portion 134 flows into the stopper 137 through the second large diameter hole 152, the orifice 107 and the first large diameter hole 151 formed inside the orifice piston 106. The high-pressure fuel flowing into the stopper 137 flows into the first fuel port (outlet port) 135 as an opening end of the cylinder portion 134 of the rail main body 105 of the common rail 103 through the penetration hole 138 of the stopper 137. The high-pressure fuel flowing into the first fuel port 135 flows into the injector 104 mounted in the first cylinder through the fuel passage 147 formed inside the pipe 113. The high-pressure fuel is injected into the combustion chamber of the first cylinder from the injector 104.

Thus, in the present embodiment, the high-pressure fuel accumulated in the pressure accumulation chamber 131 of the rail main body 105 of the common rail 103 is injected and supplied into the combustion chamber of the first cylinder of the engine while the electromagnetic valve 126 of the injector 104 is energized and the nozzle needle opens the multiple injection holes formed in the nozzle body tip end of the fuel injection nozzle. If the electromagnetic valves 126 of the injectors 104 mounted in the cylinders (second to fourth cylinders) other than the first cylinder are energized in series, the high-pressure fuel accumulated in the pressure accumulation chamber 131 of the rail main body 105 of the common rail 103 is distributed into the injectors 104 mounted in the second to fourth cylinders and is supplied into the combustion chambers of the second to fourth cylinders of the engine through the injection in series. Thus, the engine is operated.

As described above, in the common rail 103 according to the present embodiment, as shown in FIG. 14, the orifice pistons 106 are slidably incorporated in the inside-outside communication holes 133 of the multiple cylinder portions 134 of the rail main body 105 respectively. The orifice 107 is formed inside each orifice piston 106.

Because of the reciprocal and linear movement of the plunger driven by the cam inside the supply pump 102, the high-pressure fuel is intermittently discharged into the pressure accumulation chamber 131 of the rail main body 105 of the common rail 103 from the discharge hole of the supply pump 102 through the pipe 112 in a predetermined cycle. Accordingly, the high pressure is generated in a fluctuating manner inside the fuel passage 146 of the pipe 112 in accordance with the shape of the cam. The pressure pulsation (discharge fluctuation of the supply pump 102) is propagated into the inside-outside communication hole 133 of the cylinder portion 134 as a pressure wave.

If the pressure pulsation is generated upstream of the orifice piston 106 with respect to the fuel flow direction and reaches (acts on) the first pressure receiving face of the orifice piston 106 in the form of the pressure wave, the orifice piston 106 is affected by the pressure wave and moves to a low-pressure side (downward in FIG. 14). Accordingly, the pressure pulsation propagated into the inside-outside communication hole 133 is attenuated. Since the orifice 107 is formed inside the orifice piston 106, the pressure pulsation is attenuated further by the orifice effect of the orifice 107.

The injectors 104 connected with the multiple cylinder portions 134 perform fuel injections into the combustion chambers of the respective cylinders of the engine by intermittently opening at different injection timings. Accordingly, the inner pressure of the pipe 113 temporarily decreases when the injector 104 mounted in the first cylinder out of the multiple cylinders opens. The pressure pulsation of the high pressure and the low pressure is caused in the fuel passage 147 of the pipe 113. The pressure pulsation is propagated into the inside-outside communication hole 133 of the cylinder portion 134 corresponding to the first cylinder of the engine as the pressure wave (for example, a reflection wave generated in accordance with opening and closing of the injector 104 mounted in the first cylinder).

If the pressure pulsation is generated downstream of the orifice piston 106 with respect to the fuel flow direction and reaches (acts on) the second pressure receiving face of the orifice piston 106 in the form of the pressure wave, the orifice piston 106 is affected by the pressure wave and moves to a low-pressure side (upward in FIG. 14). Accordingly, the pressure pulsation propagated into the inside-outside communication hole 133 is attenuated. Since the orifice 107 is formed inside the orifice piston 106, the pressure pulsation is attenuated further by the orifice effect of the orifice 107.

Accordingly, the pressure pulsation (discharge pulsation of supply pump 102: pressure wave) propagated from the inside-outside communication hole 133 of the cylinder portion 134 into the pressure accumulation chamber 131 of the cylindrical section 132 can be reduced and restricted substantially completely. The pressure pulsation (reflection wave generated by opening and closing of injector 104 of certain cylinder: pressure wave) propagated from the inside-outside communication hole 133 of each cylinder portion 134 into the pressure accumulation chamber 131 of the cylindrical section 132 can be reduced and restricted substantially completely.

Thus, the pressure pulsation inside the pressure accumulation chamber 131 can be reduced and restricted substantially completely, so the inner pressure (common rail pressure) of the pressure accumulation chamber 131 is stabilized. As a result, influence on the injection amount characteristics of the respective cylinders of the engine (valve opening timing and valve closing timing of injectors 104, i.e., injection timing or fuel injection amount, and fuel injection pressure) can be reduced. Thus, the injection pressure difference among the cylinders and the injection amount difference among the cylinders can be reduced and restrained substantially completely. Since the pressure pulsation inside the pressure accumulation chamber 131 is reduced and restricted substantially completely, reliability of the common rail pressure sensed by the common rail pressure sensor 127 can be improved.

The orifice piston 106 according to the present embodiment is formed with the first and second large diameter portions 151, 152 having the inner diameters larger than the restrictor diameter of the orifice 107 upstream and downstream of the orifice piston 106. The manufacturing length of the orifice 107 with respect to the entire axial length of the orifice piston 106 is reduced. Accordingly, the orifice manufacturing period necessary for manufacturing process of the orifice, which requires highly-accurate manufacturing technology such as inner periphery cutting process or inner periphery grinding process, is shortened. The pressure pulsation inside the pressure accumulation chamber 131 can be reduced and restricted substantially completely without using the first and second springs provided upstream and downstream of the orifice piston with respect to the fuel flow direction unlike the common rail described in JP-A-2001-207930. The number of the parts and the number of the assembly works can be reduced, reducing a cost.

In the common rail 103 according to the present embodiment, each orifice piston 106 is formed with the sliding face 154, which can slide on the sliding face of each cylinder portion 134 in the axial direction of the inside-outside communication hole 133 of the cylinder portion 134. The sliding face 154 of each orifice piston 106 is set to be longer than the axial passage length of the orifice 107. The axial length of the sliding face 154 of each orifice piston 106 is longer than the axial passage length of the orifice 107 by the summation of the axial passage length of the first and second large diameter portions 151, 152. Accordingly, relative movement of the orifice piston 106 in the axial direction of the inside-outside communication hole 133 of each cylinder portion 134 is stabilized when the orifice piston 106 slides on the sliding face of each cylinder portion 134 in the axial direction.

Accordingly, inclination of the axial line of each orifice piston 106 with respect to the axial line of the inside-outside communication hole 133 in the inside-outside communication hole 133 is inhibited. Locking of the orifice piston 106 due to interference between the orifice piston 106 and the sliding face of the inside-outside communication hole 133 in a state in which the axial line of the orifice piston 106 is inclined with respect to the axial line of the inside-outside communication hole 133 in the inside-outside communication hole 133 is inhibited. Therefore, the effect of attenuating the pressure pulsation (pressure wave, reflection wave) propagated into the pressure accumulation chamber 131 of the rail main body 105 of the common rail 103 can be improved further, and the reliability of the sliding movement of each orifice piston 106 in the axial direction can be improved further.

The orifice pistons 106 are inserted into the inside-outside communication holes 133 of the respective cylinder portions 134, and then, the multiple stoppers 137 are mounted to the hole wall faces of the respective inside-outside communication holes 133 near the first fuel ports 135 of the multiple cylinder portions 134 by press-fitting process or the like. Thus, the common rail 103 is manufactured. The first ports 135 of the multiple cylinder portions 134 are blocked by the stoppers 137 when the common rail 103 mounted with the multiple orifice pistons 106 and the stoppers 137 is sent to a place of the next assembly process. Accordingly, coming off of the orifice pistons 106 from the first fuel ports 135 of the cylinder portions 34 can be prevented. The respective stoppers 137 may be assembled such that the stoppers 137 can be attached to and removed from the hole wall faces of the respective inside-outside communication holes 133 near the first fuel ports 135 of the multiple cylinder portions 134. For example, an inner peripheral screw (internal screw) may be formed on the inner periphery of the cylinder portion 134, and an outer peripheral screw (external screw) may be formed on an outer periphery of the stopper 137. Thus, the cylinder portion 134 and the stopper 137 may be bonded by thread connection.

Figure 16:
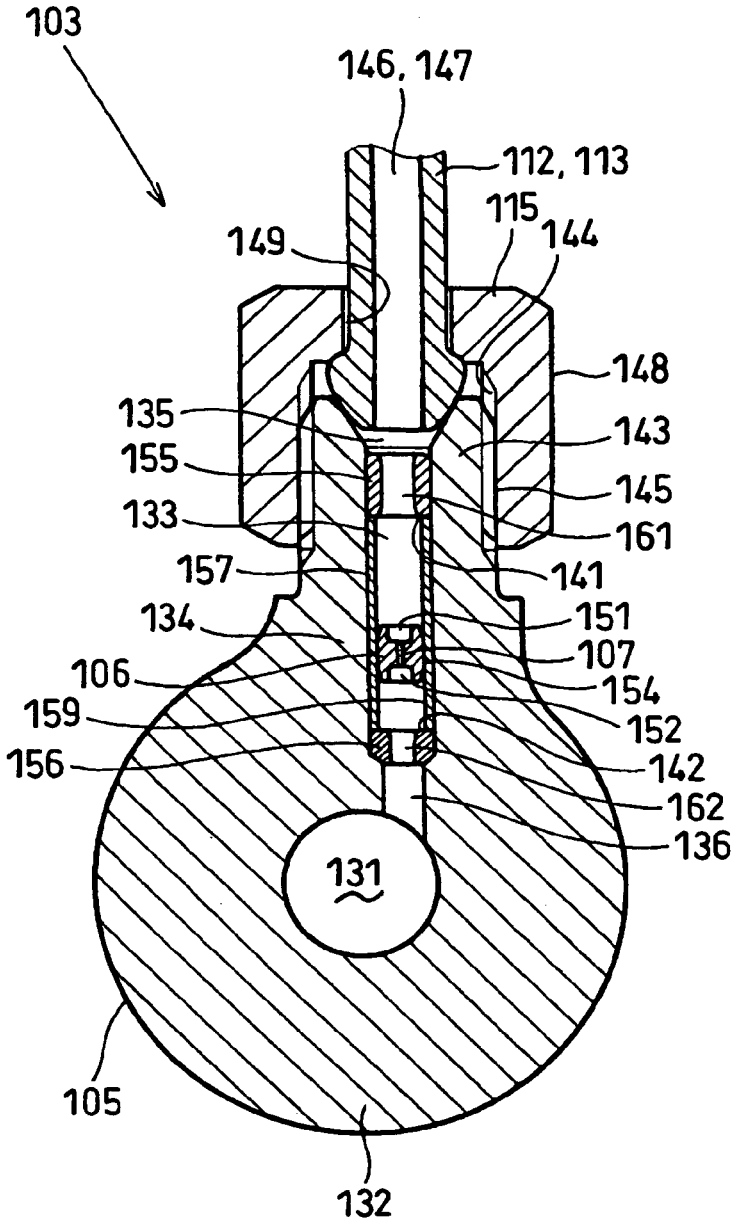
FIG. 16 is a cross-sectional view showing a common rail according to another example embodiment of the present invention.

Next, a common rail according to another example embodiment of the present invention will be explained in reference to FIG. 16. First stoppers 155 and second stoppers 156 are press-fitted into the inside-outside communication holes 133 of the cylinder portions 134 according to the present embodiment. A cylindrical liner 157 is inserted in the cylinder portion 134 between a first annular end face of each first stopper 155 and a second annular end face of each second stopper 156. The first annular end face of the first stopper 155 provides a first limiting face 141 (L1) like the stopper 137 of the first example embodiment. A first penetration hole 161 is formed in each first stopper 155 for connecting each inside-outside communication hole 133 with each first fuel port 135. The second annular end face of the second stopper 156 provides a second limiting face 142 (L2) for limiting the axial moving range of each orifice piston 106 at the time when the orifice piston 106 moves relative to each cylinder portion 134 of the rail main body 105. A second penetration hole 162 is formed in the second stopper 156 for connecting the inside-outside communication hole 133 with the second fuel port 136.

The inside-outside communication hole 133 is formed inside each liner 157. The inside-outside communication hole 133 connects the first penetration hole 161 of the first stopper 155 with the second penetration hole 162 of the second stopper 156. The inside-outside communication hole 133 extends straight substantially in the same direction as the axial direction of each cylinder portion 134 from the first annular end face of the first stopper 155 toward the second annular end face of the second stopper 156.

Finishing of the liner 157 is performed by inner periphery cutting process, inner periphery grinding process or the like such that the inner peripheral face of the liner 157 has a predetermined inner diameter, i.e., such that surface accuracy is improved. The inner peripheral face of the liner 157 provides a sliding face 159, on which the sliding face 154 of the orifice piston 106 can slide.

A predetermined clearance necessary for the orifice piston 106 to smoothly slide on the sliding face 159 of the liner 157 in the axial direction is formed between the sliding face 154 of the orifice piston 106 and the sliding face 159 of the liner 157. Thus, the orifice piston 106 is provided such that the orifice piston 106 can smoothly slide on the sliding face 159 of the liner 157. Accordingly, the effect of attenuating the pressure pulsation (pressure wave, reflection wave) propagated into the pressure accumulation chamber 131 of the rail main body 105 of the common rail 103 can be improved. In addition, the reliability of the sliding movement of each orifice piston 106 in the axial direction can be improved.

Figure 17:
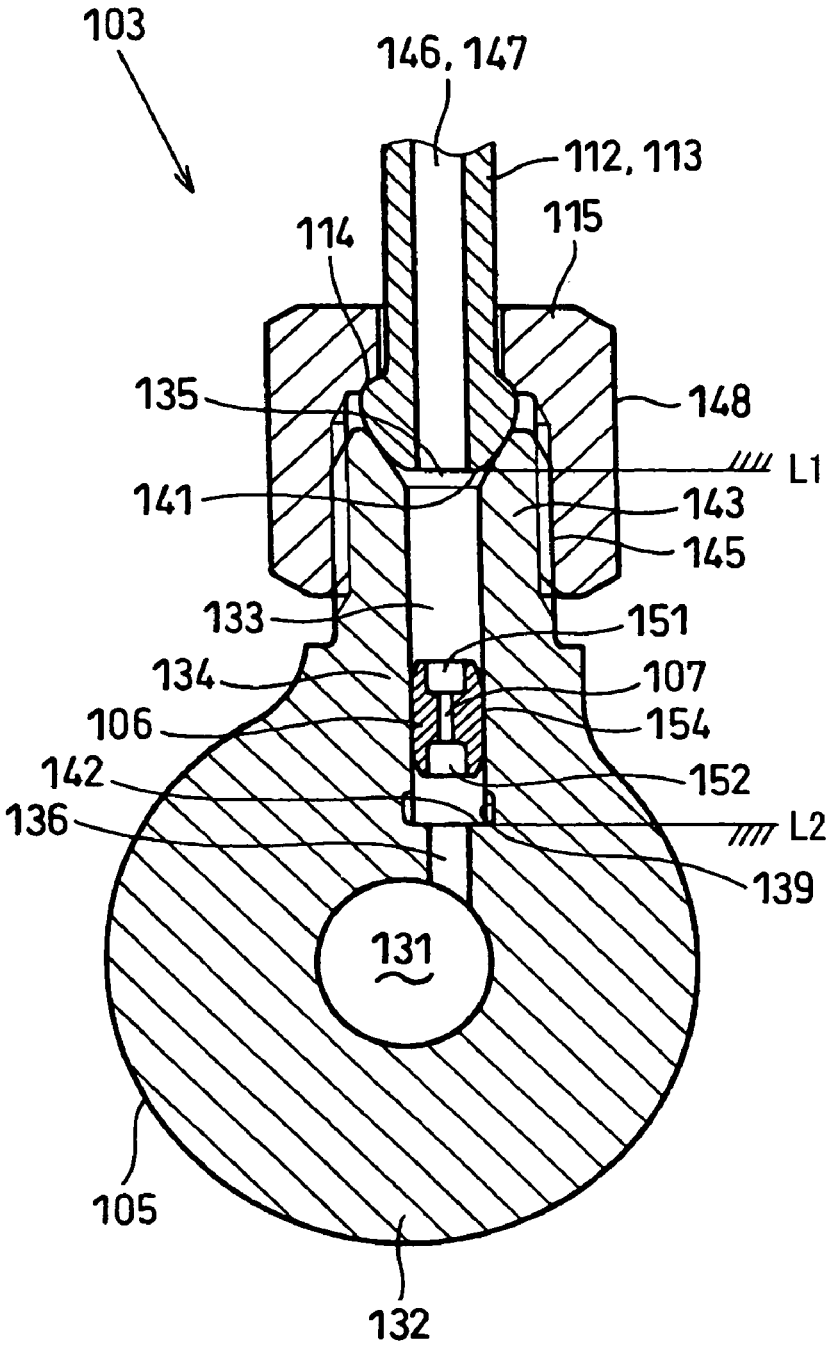
FIG. 17 is a cross-sectional view showing a common rail according to another example embodiment of the present invention.

Next, a common rail according to another example embodiment of the present invention will be explained in reference to FIG. 17. The tip end face 141 (first annular end face) of the connection head 114 of each one of the pipes 112, 113 provides a first limiting face L1 for limiting the axial moving range of each orifice piston 106 at the time when the orifice piston 106 moves relative to the cylinder portion 134 of the rail main body 105. The second annular end face 142 at the stepped portion of each cylinder portion 134 of the rail main body 105 of the common rail 103 provides a second limiting face L2 like the FIG. 13 embodiment.

In the present embodiment, instead of the stopper 137 of the FIG. 13 embodiment, the first annular end face of the connection head 114 of each one of the pipes 112, 113 is used as a stopper for preventing the coming off of the orifice piston 106 during the transportation of the rail main body 105 and for limiting the full lift amount of each orifice piston 106. Thus, the stopper 137 of the FIG. 13 embodiment can be eliminated. As a result, the number of the parts and the number of the assembling works can be reduced, reducing a cost.

Figure 18:
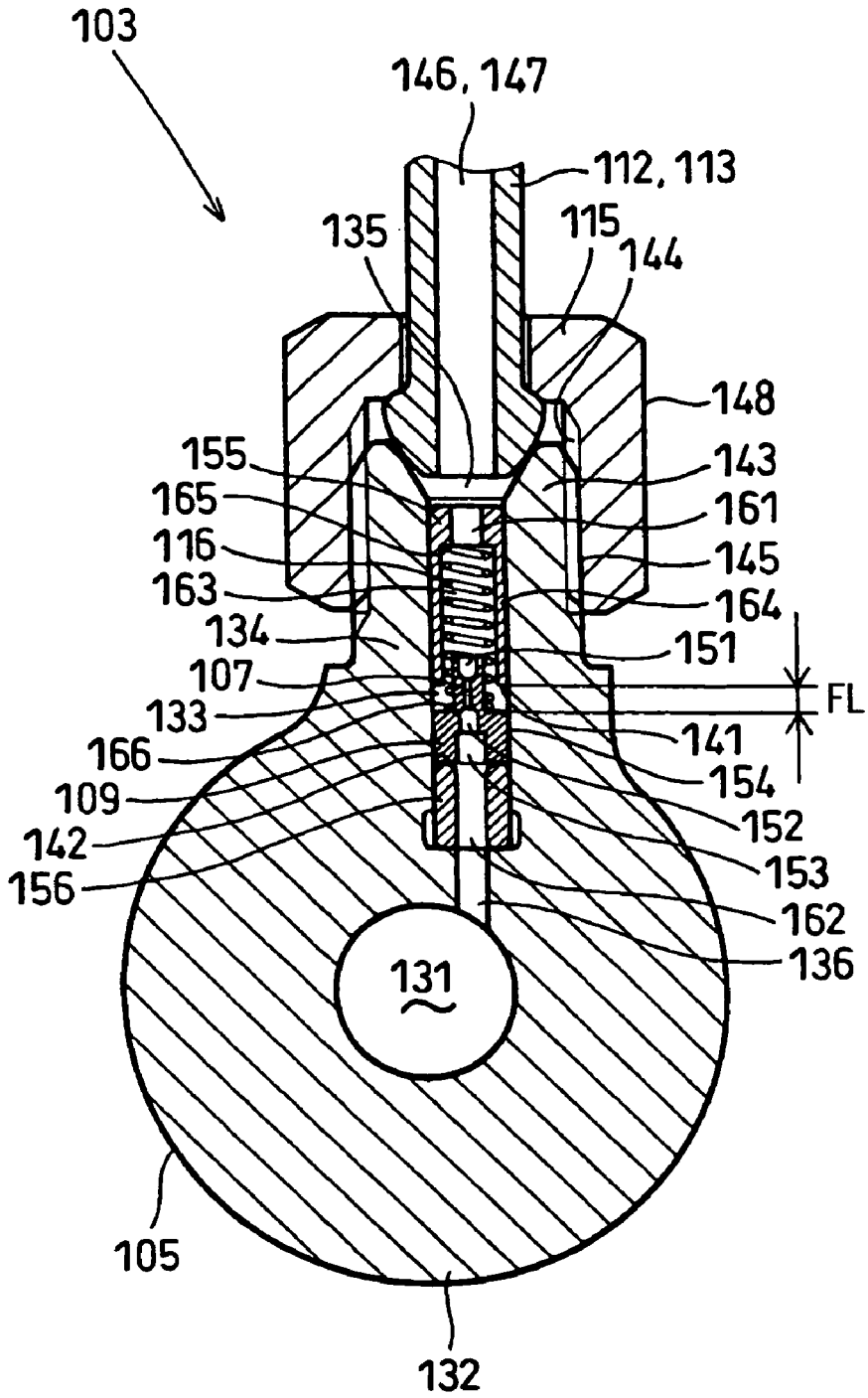
FIG. 18 is a cross-sectional view showing a common rail according to another example embodiment of the present invention.

Next, a common rail 103 according to another example embodiment of the present invention will be explained in reference to FIG. 18. First stoppers 155 and second stoppers 156 are press-fitted into the inside-outside communication holes 133 of the cylinder portions 134 according to the present embodiment. An orifice valve 109 is slidably accommodated in each cylinder portion 134 between the first annular end face of the first stopper 155 and the second annular end face of the second stopper 156 instead of the orifice piston 106 of the FIG. 13 to FIG. 17 embodiments. A coil spring 116 is incorporated in the cylinder portion 134, the first stopper 155 and the like between the first stepped portion of the first stopper 155 (opening edge of first penetration hole 161) and the second stepped portion of the orifice valve 109 (stepped portion between small diameter portion and large diameter portion).

The first stopper 155 of the present embodiment is formed with a cylindrical sleeve portion 164, which is formed with a spring accommodation chamber 163 functioning also as an inside-outside communication hole. The sleeve portion 164 extends straight from the outer periphery of the first stepped portion of the first stopper 155 toward the pressure accumulation chamber 131. A first annular end face of the sleeve portion 164 of the first stopper 155 provides a first limiting face 141 (first valve seat) for limiting the full lift amount (FL, in FIG. 18) of the orifice valve 109. A second annular end face of the second stopper 156 provides a second limiting face 142 (second valve seat) for limiting the full lift amount FL of the orifice valve 109. The first and second limiting faces 141, 142 limit the moving range of the each orifice valve 109 in the axial direction at the time when the orifice valve 109 moves relative to each cylinder portion 134 of the rail main body 105 like the FIG. 13 embodiment to the FIG. 17 embodiment.

The orifice valve 109 is a forged product or a press-molded product made of a low-hardness material such as low-carbon crude steel. Each orifice valve 109 is accommodated in the inside-outside communication hole 133 of each cylinder portion 134 of the rail main body 105 such that the orifice valve 109 can slide in the axial direction of the inside-outside communication hole 133. Each orifice valve 109 reciprocates linearly between a default position, at which the orifice valve 109 is seated on the second limiting face 142 (second valve seat) of the second stopper 156, and a full lift position, at which the orifice valve 109 is seated on the first limiting face 141 (first valve seat) of the first stopper 155.

Each orifice valve 109 has a cylindrical small diameter portion formed with a first large diameter hole 151 and an orifice 107 and a cylindrical large diameter portion (largest outer diameter portion) formed with a second large diameter hole 152 and a third large diameter hole 153 having an inner diameter larger than that of the second large diameter hole 152. A tip end of the small diameter portion of each orifice valve 109 is invariably fitted in the spring accommodation chamber 163 of the sleeve portion 164 of the first stopper 155. A clearance is invariably formed between an outer peripheral face of the small diameter portion of the orifice valve 109 and an inner peripheral face of the sleeve portion 164 of the first stopper 155.

Each orifice valve 109 has a sliding portion that surrounds the peripheries of the second and third large diameter holes 152, 153 and that is slidably held by the sliding face of the cylinder portion 134 of the rail main body 105. The outer peripheral face of the sliding portion of each orifice valve 109 provides a sliding face 154 capable of sliding on the sliding face of the cylinder portion 134 in the axial direction of the inside-outside communication hole 133 of the cylinder portion 134. Axial length of the sliding face 154 of the orifice valve 109 is larger than the axial passage length of the orifice 107 by the axial passage length of the second and third large diameter holes 152, 153.

A predetermined (minimum) clearance necessary for enabling each orifice valve 109 to linearly reciprocate (slide) in the inside-outside communication hole 133 of each cylinder portion 134 is formed between the sliding face 154 of the orifice valve 109 and the sliding face of the cylinder portion 134. An outer peripheral corner of one end (upper end in FIG. 18) of each orifice valve 109 is chamfered into a rounded shape or a conical shape to facilitate the smooth reciprocal and linear movement (sliding movement) of the orifice valve 109 in the inside-outside communication hole 133 of each cylinder portion 134.

The first contact face and a first stepped face between the first large diameter hole 151 and the orifice 107 of each orifice valve 109 function as a first pressure receiving face for receiving the fuel pressure. The second contact face and a second stepped face between the orifice 107 and the second large diameter hole 152 of each orifice valve 109 function as a second pressure receiving face for receiving fuel pressure. In the present embodiment, the orifice valve 109 is pressed against the second limiting face 142 of the second stopper 156 by the spring load of the coil spring 116. Accordingly, the orifice valve 109 does not descend further than the state shown in FIG. 18 even if the pressure on the first pressure receiving face side is higher than the pressure on the second pressure receiving face side.

The first stepped portion of the first stopper 155 (opening edge of first penetration hole 161) provides an annular first spring seat 165 for receiving the spring load of the coil spring 116. The second stepped portion (stepped portion between small diameter portion and large diameter portion) of the orifice valve 109 provides an annular second spring seat 166 for receiving the spring load of the coil spring 116.

Each coil spring 116 is accommodated in the inside-outside communication hole 133 of each cylinder portion 134 and the spring accommodation chamber 163 of the sleeve portion 164 of the first stopper 155. The coil spring 116 is provided between the first spring seat 165 of each first stopper 155 and the second spring seat 166 of each orifice valve 109 such that the spring 116 can be elastically deformed in the axial direction. The coil inner periphery of the coil spring 116 is held by the outer peripheral face of the small diameter portion of each orifice valve 109. The coil outer periphery of the coil spring 116 is held by the inner peripheral face of the sleeve portion 164 of the first stopper 155. The coil spring 116 applies the spring load to each orifice valve 109 in a direction for pressing the second contact face of the orifice valve 109 against the second limiting face 142 of the second stopper 156.

Thus, in the common rail 103 according to the present embodiment, the lifting amount of the orifice valve 109 is restrained by the spring load of the single coil spring 116 when the pressure pulsation (pressure wave) generated in the pressure accumulation chamber 131 of the rail main body 105 acts on (reaches) the second pressure receiving face of the orifice valve 109 and the orifice valve 109 moves (lifts) in the direction (upward direction in FIG. 18) for separating from the second limiting face 142 of the second stopper 156. Accordingly, the effect of attenuating the pressure pulsation (pressure wave) propagated to the inside of the pressure accumulation chamber 131 of the rail main body 105 of the common rail 103 can be improved. In the common rail 103 according to the present embodiment, one coil spring 116 is accommodated in each inside-outside communication hole 133 of the cylinder portion 134 of the rail main body 105. Accordingly, the number of the elastic members (springs) such as the coil springs 116 can be minimized. Thus, the number of parts and the number of assembly works can be reduced, reducing a cost.

Figure 19:
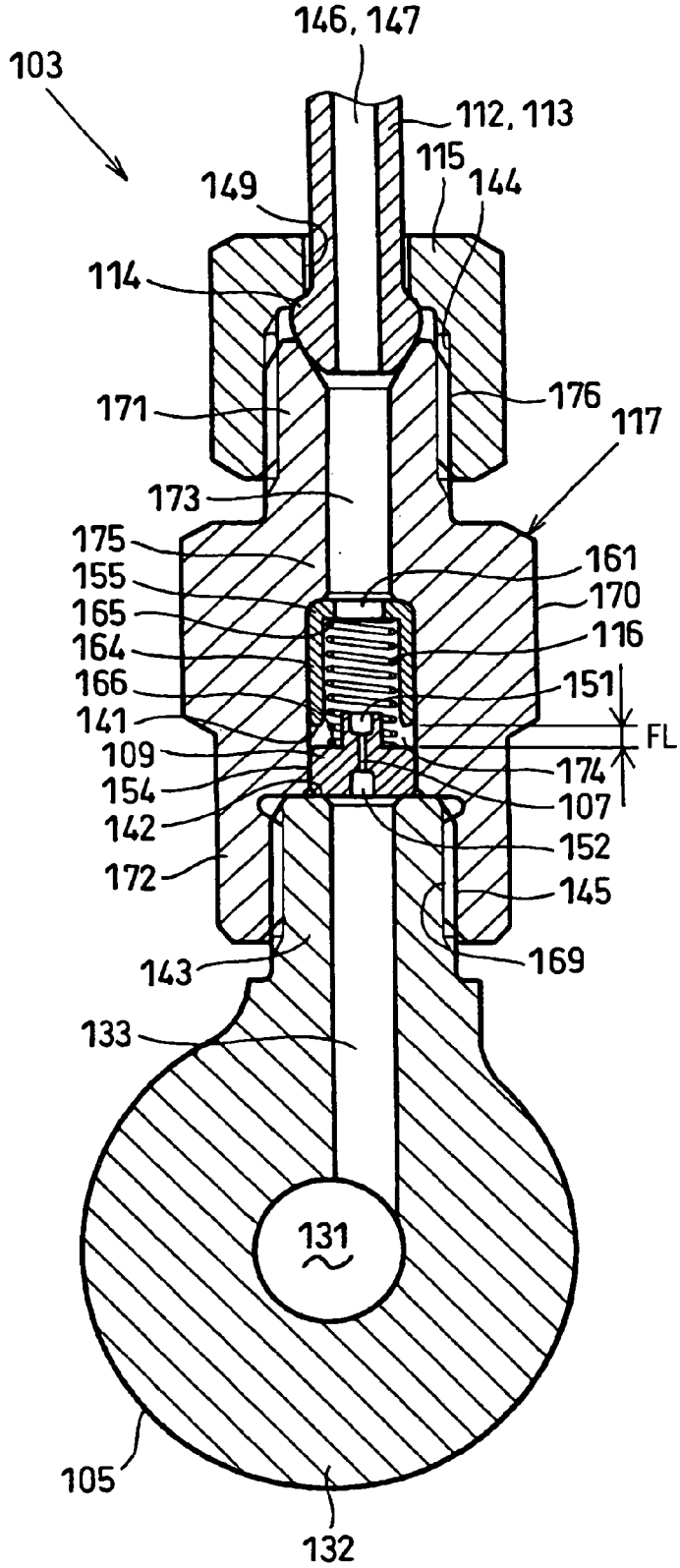
FIG. 19 is a cross-sectional view showing a common rail according to yet another example embodiment of the present invention.

Next, a common rail according to yet another example embodiment of the present invention will be explained in reference to FIG. 19. The common rail 103 according to the present embodiment has a rail main body 105 for accumulating high-pressure fuel inside and multiple pipe connectors 117 screwed and fastened to pipe fastening portions 143 (circular pipes) of the rail main body 105. In the present embodiment, an orifice valve 109, a coil spring 116 and a first stopper 155 are accommodated in each pipe connector 117. The rail main body 105 has a cylindrical section 132 formed with a pressure accumulation chamber 131 inside. The pipe fastening portions 143 protrude from the outer periphery of the cylindrical section 132 outward in the radial direction of the cylindrical section 132. An inside-outside communication hole 133 is formed in each pipe fastening portion 143.

Each pipe fastening portion 143 functions as a connector portion, to which the pipe connector 117 is screwed and fixed. The outer periphery of the pipe fastening portion 143 is formed with an outer peripheral screw 145 (external screw) screwed with an inner peripheral screw 169 (internal screw) formed on an inner periphery of the pipe connector 117. A first annular end face of the sleeve portion 164 of the first stopper 155 provides a first limiting face 141 (first valve seat) for limiting the full lift amount FL of the orifice valve 109. A second annular end face of the opening edge of the pipe fastening portion 143 provides a second limiting face 142 (second valve seat) for limiting the full lift amount FL of the orifice valve 109. The first and second limiting faces 141, 142 limit the moving range of the each orifice valve 109 in the axial direction at the time when the orifice valve 109 moves relative to each cylinder portion 134 of the rail main body 105 like the FIG. 18 embodiment.

Each pipe connector 117 has a hexagonal engaging portion 170, a first cylindrical section 171 and a second cylindrical section 172. A screwing tool can be engaged with the engaging portion 170. The first cylindrical section 171 is provided upstream (or downstream) of the engaging portion 170 with respect to the fuel flow direction. The second cylindrical section 172 is provided downstream (or upstream) of the engaging portion 170 with respect to the fuel flow direction. The first and second cylindrical sections 171, 172 have outer diameters smaller than the outer diameter of the engaging portion 170 in one embodiment. The first cylindrical section 171 has the outer diameter smaller than that of the second cylindrical section 172 in one embodiment. The engaging portion 170 and the first and second cylindrical sections 171, 172 have a cylinder portion 175. First and second inside-outside communication holes 173, 174 communicating with each other through the first penetration hole 161 of the first stopper 155 are formed in the cylinder portion 175.

The first inside-outside communication hole 173 is a first communication passage connecting the second inside-outside communication hole 174 on the pressure accumulation chamber side and each of the fuel passages 146, 147 of the external pipes 112, 113. The first inside-outside communication hole 173 has an inner diameter larger than that of the first penetration hole 161 of the first stopper 155. The second inside-outside communication hole 174 is a second communication passage connecting the inside-outside communication hole 133 on the pressure accumulation chamber side with the first inside-outside communication hole 173 on the outer side. The second inside-outside communication hole 174 has an inner diameter larger than those of the first penetration hole 161 of the first stopper 155 and the first inside-outside communication hole 173. The hole wall face of the cylinder portion 175 on the other side (lower side in FIG. 19) of the second inside-outside communication hole 174 with respect to the axial direction provides a sliding face, on which the sliding portion (sliding face) 154 provided on the outer peripheral face of the orifice valve 109 can slide.

The first cylindrical section 171 of the pipe connector 117 functions as a first connector portion for screwing and fixing the connection head 114 formed in the shape of a flange at the downstream end of the pipe 112 or the upstream end of the pipe 113 by using a pipe fastening nut 115. The outer periphery of the first cylindrical section 171 is formed with an outer peripheral screw 176 (external screw) screwed with an inner peripheral screw 144 (internal screw) formed on the inner periphery of the pipe fastening nut 115. The inner peripheral screw 144 of the pipe fastening nut 115 is fitted with the outer peripheral screw 176 of the first cylindrical section 171 and is screwed to the outer peripheral screw 176 of the first cylindrical section 171 in a state in which the locking portion of the pipe fastening nut 115 locks the stepped portion of the connection head 114 of each of the pipes 112, 113. Thus, a seat face formed in the shape of a truncated cone on the outer periphery of the connection head 114 of each of the pipes 112, 113 is pressed against the inner peripheral face (pressure receiving seat face in the shape of a truncated cone) of the opening end of the pipe connector 117. Thus, liquid-tight hermetic sealing, i.e., metal sealing, is achieved between the connection head 114 of each of the pipes 112, 113 and the pipe connector 117.

The second cylindrical section 172 of each pipe connector 117 functions as a second connector portion fastened and fixed to each pipe fastening portion 143 of the rail main body 105. The inner periphery of each second cylindrical section 172 is formed with an inner peripheral screw 169 screwed with an outer peripheral screw 145 formed on the outer periphery of each pipe fastening portion 143 of the rail main body 105. The outer peripheral screw 145 of the pipe fastening portion 143 is fitted with the inner peripheral screw 169 of the second cylindrical section 172 and the pipe connector 117 is screwed to the outer peripheral screw 145 of the pipe fastening portion 143. Thus, the stepped face of the pipe connector 117 is pressed against the pressure receiving face of the pipe fastening portion 143, so liquid-tight and hermetic sealing, i.e., metal sealing, is made between the pipe fastening portion 143 of the rail main body 105 and the pipe connector 117.

The first contact face and a first stepped face between the first large diameter hole 151 and the orifice 107 of each orifice valve 109 function as a first pressure receiving face for receiving fuel pressure. The second contact face and a second stepped face between the orifice 107 and the second large diameter hole 152 of each orifice valve 109 function as a second pressure receiving face for receiving fuel pressure. In the present embodiment, the orifice valve 109 is pressed against the second limiting face 142 of the pipe fastening portion 143 (opening edge) by the spring load of the coil spring 116. Accordingly, the orifice valve 109 does not descend further than the state shown in FIG. 19 even if the pressure on the first pressure receiving face side is higher than the pressure on the second pressure receiving face side.

The first stepped portion of the first stopper 155 (opening edge of first penetration hole 161) provides an annular first spring seat 165 for receiving the spring load of the coil spring 116. The second stepped portion (stepped portion between small diameter portion and large diameter portion) of the orifice valve 109 provides an annular second spring seat 166 for receiving the spring load of the coil spring 116.

The orifice 107 formed in each orifice valve 109 has a passage cross-sectional area much smaller than a passage cross-sectional area of the second inside-outside communication hole 174. Each orifice valve 109 is formed with a first large diameter hole 151 upstream of (or downstream of) the orifice 107 with respect to the flow direction of the fuel and with a second large diameter hole 152 downstream (or upstream) of the orifice 107 with respect to the flow direction of the fuel. The first annular end face on an outer side of the large diameter portion (largest outer diameter portion) of each orifice valve 109 provides a first contact face capable of contacting the first limiting face 141 (L1) of the first stopper 155, which is press-fitted into the cylinder portion 175, when the orifice valve 109 moves relative to the cylinder portion 175.

The second annular end face of the large diameter portion (largest outer diameter portion) of the orifice valve 109 on the pressure accumulation chamber side provides a second contact face capable of contacting the second limiting face 142 formed integrally with the pipe fastening portion 143 of the rail main body 105 when the orifice valve 109 moves relative to the cylinder portion 175. The coil spring 116 applies the spring load to each orifice valve 109 in a direction for pressing the second contact face of the orifice valve 109 against the second limiting face 142 of the pipe fastening portion 143. The first stopper 155 is press-fitted near the opening end of the second inside-outside communication hole 174 in the cylinder portion 175.

Thus, in the common rail 103 according to the present embodiment, the lifting amount of the orifice valve 109 is restricted by the spring load of the coil spring 116 when the pressure pulsation (pressure wave) generated in the pressure accumulation chamber 131 of the rail main body 105 acts on (reaches) the second pressure receiving face of the orifice valve 109 and the orifice valve 109 moves (lifts) in the direction (upward direction in FIG. 19) for separating from the second limiting face 142 of the pipe fastening portion 143. Accordingly, the effect of attenuating the pressure pulsation (pressure wave) propagated into the pressure accumulation chamber 131 of the rail main body 105 of the common rail 103 can be improved. Since one coil spring 116 is accommodated in each second inside-outside communication hole 174 of the cylinder portion 175 of the rail main body 105 of the common rail 103 of the present embodiment, the number of the elastic members (springs) such as the coil springs 116 can be minimized. Thus, the number of parts and the number of assembly works can be reduced, reducing a cost.

In the above described embodiments, the rail main body 105 has the cylindrical section 132 formed with the pressure accumulation chamber 131 inside as the forged product or the press-molded product made of a low-hardness material such as low-carbon crude steel. Alternatively, the rail main body 105 may have a cylindrical section in the shape of an elliptic cylinder or an oblong circle cylinder formed with a pressure accumulation chamber 131 inside. The pipe connectors 117 may be directly connected to the cylindrical section 132 of the rail main body 105 without providing the cylinder portions or the pipe portions in the rail main body 105. The connecting method of the rail main body 105 and the pipe connectors 117 is not limited to thread connection. For example, a welding process may be used.

In the above-described embodiments, the cylinder portion 134 (175), into which the high-pressure fuel is introduced from the supply pump 102 through the pipe (high-pressure pump pipe) 112, and the cylinder portions 134 (175) for supplying the high-pressure fuel, which is accumulated in the pressure accumulation chamber 131, to the injectors 104 mounted in the respective cylinders through the pipes (injector pipes) 113 protrude from the outer periphery of the cylindrical section 132 of the rail main body 105 substantially in the same direction. The protruding directions of the cylinder portions 134 (175) may be differentiated. For example, the cylinder portion 134 (175) connected with the pipe (high-pressure pump pipe) 112 may protrude in a direction (180°) opposite to the direction of the cylinder portions 134 (175) connected with the pipes (injector pipes) 113. The protruding directions of the cylinder portions 134 (175) is not limited to the direction substantially perpendicular to the axial direction of the pressure accumulation chamber 131 of the rail main body 105. The protruding directions may be arbitrarily set in accordance with a pipe layout.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A common rail comprising:

a pressure accumulation chamber for accumulating high-pressure fuel inside;

a pipe joint formed with an external screw on an outer peripheral face thereof, the external screw being connectable with an external pipe;

an inside-outside communication hole for providing communication between a central portion of an outer end of the pipe joint and the pressure accumulation chamber; and a bush press-fitted to an inside of the inside-outside communication hole, wherein the bush is formed with a press-fitted portion press-fitted into the inside-outside communication hole and with multiple steps of orifices on an inner peripheral face of the bush for narrowing a fuel flow passage of the inside-outside communication hole such that the orifice having the smallest inner diameter is deviated from the press-fitted portion in an axial direction of the bush to prevent an overlap between the orifice having the smallest inner diameter and the press-fitted portion in a radial direction of the bush, the orifice of the bush having the smallest inner diameter is provided on a pressure accumulation chamber side of the press-fitted portion, an internal diameter of the inside-outside communication hole between the pressure accumulation chamber and a tip end portion of the bush on the pressure accumulation chamber side is larger than an external diameter of the tip end portion of the bush on the pressure accumulation chamber side.

2. The common rail as in claim 1, wherein the orifices include an adjacent orifice adjacent to the orifice having the smallest inner diameter, and the bush is formed with a tapered face formed at an outer peripheral face of a transitional portion between the orifice having the smallest inner diameter and the adjacent orifice.

3. The common rail as in claim 2, wherein the tapered face has an outer diameter reducing toward the pressure accumulation chamber.

4. The common rail as in claim 1, wherein the orifices include an adjacent orifice adjacent to the orifice having the smallest inner diameter, and the bush is formed with a step formed at an outer peripheral face of a transitional portion between the orifice having the smallest inner diameter and the adjacent orifice.

5. The common rail as in claim 1, wherein the external screw of the pipe joint has a screw end on the pressure accumulation chamber side, and the press-fitted portion of the bush is press-fitted into the inside-outside communication hole at a press-fitting position overlapping with the screw end in a radial direction of the inside-outside communication hole.

6. The common rail as in claim 1, wherein the inside-outside communication hole is formed with a pressure release periphery on an insertion side of the bush, the pressure release periphery having an inner diameter larger than an outer diameter of the press-fitted portion of the bush.

7. The common rail as in claim 6, wherein the inside-outside communication hole is formed with a press-fitting periphery that is formed on a deeper side than the pressure release periphery and that has an inner diameter smaller than the outer diameter of the press-fitted portion of the bush by a press-fitting margin.

8. The common rail as claim 7, wherein the press-fitted portion has axial length greater than length between an end of the external pipe attached to the pipe joint and an end of the press-fitting periphery on a side closer to the pressure release periphery in the case where the external pipe is attached to the pipe joint.

9. The common rail as claim 7, further comprising:

a prevention member inside the pressure release periphery for preventing coming off of the bush by contacting the external pipe attached to the pipe joint and the bush, wherein the press-fitted portion of the bush has axial length greater than a difference between length from an end of the external pipe attached to the pipe joint to an end of the press-fitting periphery on a side closer to the pressure release periphery and axial length of the prevention member in the case where the external pipe is attached to the pipe joint.

10. The common rail as in claim 1, wherein the inside-outside communication hole is formed with a press-fitting periphery that extends to an end thereof on a pipe joint side and has an inner diameter smaller than an outer diameter of the press-fitted portion of the bush.

11. A common rail comprising:

a pressure accumulation chamber for accumulating high-pressure fuel inside;

a pipe joint formed with an external screw on an outer peripheral face thereof, the external screw being connectable with an external pipe;

an inside-outside communication hole for providing communication between a central portion of an outer end of the pipe joint and the pressure accumulation chamber; and a bush that is provided inside the inside-outside communication hole, wherein the bush is press-fitted to an inside of the inside-outside communication hole and is formed with an orifice for narrowing a fuel flow passage of the inside-outside communication hole, wherein the bush is formed with a press-fitted portion press-fitted into the inside-outside communication hole at a position where the press-fitted portion does not overlap with the external screw in a radial direction of the inside-outside communication hole.

12. The common rail as in claim 11, wherein the inside-outside communication hole is formed with a pressure release periphery on an insertion side of the bush, the pressure release periphery having an inner diameter larger than an outer diameter of the press-fitted portion of the bush, and with a press-fitting periphery that is formed on a deeper side than the pressure release periphery and that has an inner diameter smaller than the outer diameter of the press-fitted portion of the bush by a press-fitting margin.

13. The common rail as in claim 11, wherein the press-fitted portion has axial length greater than length between an end of the external pipe attached to the pipe joint and an end of the press-fitting periphery on a side closer to the pressure release periphery in the case where the external pipe is attached to the pipe joint.

14. The common rail as in claim 12, further comprising:

a prevention member inside the pressure release periphery for preventing coming off of the bush by contacting the external pipe attached to the pipe joint and the bush, wherein the press-fitted portion of the bush has axial length greater than a difference between length from an end of the external pipe attached to the pipe joint to an end of the press-fitting periphery on a side closer to the pressure release periphery and axial length of the prevention member in the case where the external pipe is attached to the pipe joint.

15. The common rail as in claim 11, wherein the inside-outside communication hole is formed with a press-fitting periphery that extends to an end thereof on a pipe joint side and has an inner diameter smaller than an outer diameter of the press-fitted portion of the bush.

* * * * *